United States Patent [19]

Sumita et al.

[11] Patent Number: 4,588,488

[45] Date of Patent: May 13, 1986

[54] METHOD OF REMOVING OXIDE ON METAL SURFACE

[75] Inventors: Osao Sumita, Hitachi; Masayuki Saito, Mito; Hisao Itou; Masahito Kobayashi, both of Hitachi; Yasumasa Furutani, Katsuta, all of Japan

[73] Assignees: Hitachi, Ltd., Tokyo; Hitachi Engineering Co., Ltd., Ibaraki, both of Japan

[21] Appl. No.: 617,917

[22] Filed: Jun. 6, 1984

Related U.S. Application Data

[63] Continuation of Ser. No. 322,207, Nov. 17, 1981, abandoned.

[30] Foreign Application Priority Data

Nov. 17, 1980 [JP] Japan ..... 55-162458

[51] Int. Cl.[4] ..... C25F 1/06

[52] U.S. Cl. ..... 204/145 R

[58] Field of Search ..... 204/145 R, 145 F; 134/1, 2

[56] References Cited

U.S. PATENT DOCUMENTS

| | | | |
|---|---|---|---|
| 2,889,837 | 6/1959 | Braun | 134/140 |
| 2,915,444 | 12/1959 | Meyer | 204/145 R |
| 3,293,159 | 12/1966 | Mekjean | 204/61 |
| 3,715,292 | 2/1973 | Wieczorek | 204/145 R |
| 3,943,043 | 3/1976 | Billington | 204/146 |
| 4,028,135 | 6/1977 | Vig | 134/1 |
| 4,264,418 | 4/1981 | Wood | 204/129.95 |
| 4,368,080 | 1/1983 | Tavgen | 134/1 |

OTHER PUBLICATIONS

Corrosion, vol. 11, Apr. 1955, pp. 161–181.

*Primary Examiner*—T. M. Tufariello

*Attorney, Agent, or Firm*—Antonelli, Terry & Wands

[57] ABSTRACT

An object to-be-washed bearing an oxide on the surface of a parent material metal is immersed in a liquid containing a complexing agent, electrons having energy levels on the base side with respect to the Fermi level of the oxide are generated outside the parent material metal by supplying external energy, and the electrons are injected into the oxide of the object to-be-washed immersed in the liquid.

24 Claims, 29 Drawing Figures

METHOD OF REMOVING OXIDE ON METAL SURFACE

This is a continuation of application Ser. No. 322,207, filed Nov. 17, 1981 now abandoned.

BACKGROUND OF THE INVENTION

This invention relates to a method of removing an oxide on a metal surface, and more particularly to a method of removing a metal surface oxide as is suitable for preventing the corrosive damage of a metal being a parent material.

On those inner surfaces of equipment and piping installed in a thermal power plant, nuclear power plant, chemical plant or the like plant which come into contact with a fluid, an oxide adheres or grows with increase in the operation years of the plant. Since such oxide is feared to hamper the functions of the equipment and the piping, it is desired to be removed.

Especially in the nuclear power plant, radioactive ions in cooling water which flows within the nuclear power plant stick to the oxide adherent on the inner surfaces of the equipment and piping of the plant or are accepted into the oxide during the growth of the films of the oxide which are formed on the inner surfaces of the equipment and piping. In consequence, the radiation doses of the surfaces of the equipment and piping increase. This hinders the maintenance and inspection of the equipment, the piping etc., and conspicuously prolongs the period of time required for the maintenance and inspection. Also to the end of readily executing the maintenance and inspection in a short time, the oxide formed on the inner surfaces of the equipment and piping need to be removed on occasion.

Methods of removing an oxide from a metal surface as have heretofore been often performed use a solution in which an acid, a complexing agent and a reducing agent are mixed, as disclosed in the official gazettes of Japanese Patent Publication Nos. 731 (1978) and 20252 (1978). With such methods, the metal of the parent material is also corroded and damaged.

SUMMARY OF THE INVENTION

An object of this invention is to provide a method of removing a metal surface oxide as can suppress the corrosion of a parent material metal.

This invention is characterized in that an object to-be-washed bearing an oxide on a surface of a parent material metal is immersed in a liquid containing a complexing agent, that electrons having energy levels lying on a base side with respect to a Fermi Level of the oxide are generated outside the parent material metal by supply of external energy, and that the electrons are injected into the oxide of the object-to-be-washed immersed in the liquid.

DETAILED DESCRIPTION OF THE PREFERRED EMBODIMENTS

Figure 1:
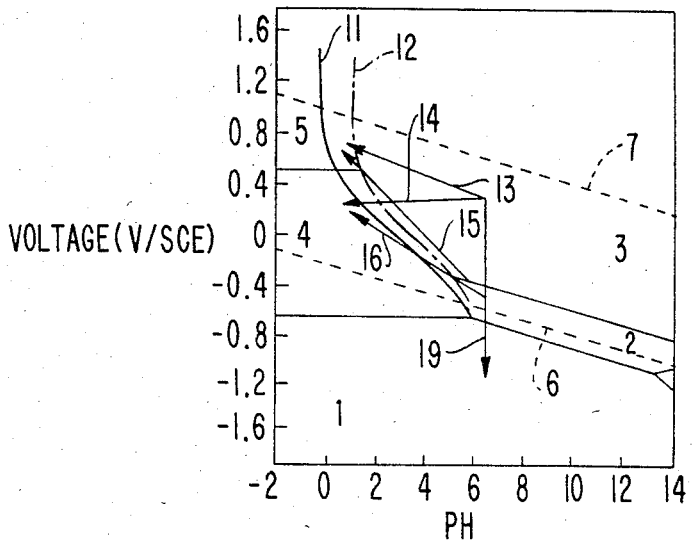
FIG. 1 is a pool diagram showing the relationship between the pH and the potential in an iron-iron oxide system.

This invention has been made on the basis of new knowledge obtained by fully studying the conventional methods of removing oxides.

There will be explained a pool diagram of FIG. 1 which illustrates the concept of the thermodynamically stable regions of iron oxides and metal iron. SCE indicated in the unit of potential in FIG. 1 stands for "saturated calomel electric potential". Potentials in the following description shall be indicated in terms of the SCE. A region 1 is a region in which metal iron is thermodynamically stable. A region 2 is a region in which $Fe_3O_4$ being an iron oxide is thermodynamically stable, while a region 3 is a region in which $\alpha Fe_2O_3$ being an iron oxide becomes a thermodynamically stable state. A region 4 is a region where the ion of $Fe^{2+}$ is thermodynamically stable. Further, a region 5 is a region where the ion of $Fe^{3+}$ is thermodynamically stable. The regions 4 and 5 are regions where corrosion develops in the metal iron. When the condition of a broken line 6 has been established, hydrogen under 1 atm. is generated. In addition, when the condition of a broken line 7 has been established, oxygen under 1 atm. is generated.

The dissolution and removal of iron oxides employing a wash liquid will be explained. FIG. 2(A) shows the situation of adhesion of iron oxides in a part of piping before wash. A layer of ferroferric oxide ($Fe_3O_4$) 9 is formed on the surface of metal iron 8 being the parent material of the pipe, and a layer of ferric oxide ($Fe_2O_3$) 10 is further formed on the surface of the $Fe_3O_4$ layer 9. The ferric oxide layer 10 lies in contact with neutral cooling water which flows through the pipe. During the wash, a wash liquid which contains an acid, a complexing agent and a reducing agent is kept flowing through the pipe instead of the cooling water. Under the action of the complexing agent, the boundary line 11 in FIG. 1 between the region 3 and the regions 4 and 5 shifts to the position of a dot-and-dash line 12, so that the regions in which the iron oxides are stable become smaller. Thus, the dissolution of the iron oxides is promoted. Owing to the contact of the $Fe_2O_3$ layer 10 with the wash liquid, the reaction of the following formula in which the region 3 changes to the region 5 as indicated by a straight line 13 in FIG. 1 is conducted:

$$Fe_2O_3+6H^+\rightarrow 2Fe^{3+}+3H_2O \quad (1)$$

Here, $H^+$ corresponds to the acid. Under the action of the reducing agent contained in the wash liquid, $Fe^{3+}$ liquated in the wash liquid by the reaction of Formula (1) accepts an electron $e^-$ from the reducing agent and changes to $Fe^{2+}$ which is more difficult to flocculate than $Fe^{3+}$, as indicated by the following formula:

$$Fe^{3+}+e^-\rightarrow Fe^{2+} \quad (2)$$

Figure 2A:
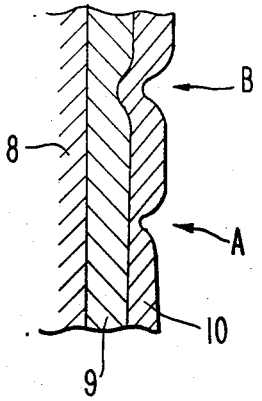
FIGS. 2(A), 2(B), 2(C), 2(D) and 2(E) are explanatory diagrams showing the stages of dissolution of oxides adherent to an object to-be-washed in a prior-art method.
Figure 2B:
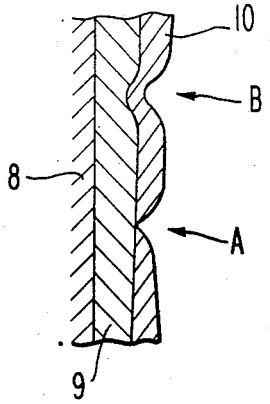

When the dissolution and removal of the $Fe_2O_3$ layer 10 based on Formula (1) has proceeded, the $Fe_2O_3$ layer 10 at the thinnest part A in FIG. 2(A) disappears, and the $Fe_3O_4$ layer 9 comes into contact with the wash liquid as shown in FIG. 2(B). Thus, the reaction of the following formula (3) in which the region 2 changes to the region 5 as indicated by a straight line 15 in FIG. 1 is performed:

$$Fe_3O_4+8H^+\rightarrow 2Fe^{3+}+Fe^{2+}+4H_2O \quad (3)$$

Figure 2C:
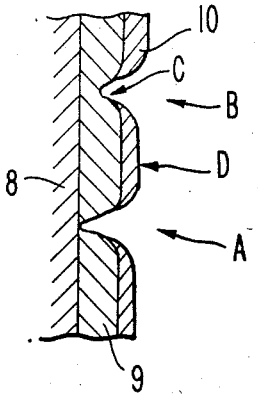

$Fe^{3+}$ liquated in the wash liquid on the basis of the reaction of Formula (3) changes to $Fe^{2+}$ owing to its reaction with the reducing agent indicated by Formula (2). In a state shown in FIG. 2(B), the dissolution and removal of the iron oxides existing on the surface of the metal iron 8 as based on the reactions of Formulae (1), (2) and (3) is performed. When the dissolution of the iron oxides has further progressed, the metal iron 8 comes into contact with the wash liquid at the part A as shown in FIG. 2(C). Also at a part B (refer to FIG. 2(B)), the $Fe_3O_4$ layer 9 is dissolved and removed. At the part A, the reaction of Formula (4) mentioned below takes place. The reaction of Formula (5) sometimes takes place in the surface of a fraction of the part A.

$$Fe\rightarrow Fe^{2+}+2e^- \quad (4)$$

$$2H^++2e^-\rightarrow H_2 \quad (5)$$

That is, when the metal iron 8 has come into contact with the wash liquid, it is dissolved and generates electrons on the basis of the reaction of Formula (4). A very small proportion of the electrons reacts with the acid in the wash liquid and generates hydrogen as indicated by Formula (5). This signifies that the anodic reaction (Formula (4)) is chiefly occurring in the surface of the metal iron 8. A cathodic reaction which corresponds to the anodic reaction occurs in a certain place of the $Fe_3O_4$ layer 9 or $Fe_2O_3$ layer 10 lying in contact with the wash liquid. Let it be supposed by way of example that the cathodic reaction is occurring at a part C in FIG. 2(C). In this case, the reaction of the $Fe_3O_4$ layer 9 at the part C becomes as indicated by Formula (6), while the cathodic reaction occurring in the $Fe_2O_3$ layer 10 near the part C becomes as indicated by Formula (7). Formula (6) denotes the reaction of the change of from the region 2 to the region 4 as indicated by a straight line 16 in FIG. 1. On the other hand, Formula (7) denotes the reaction of the change of from the region 3 to the region 4 as indicated by a straight line 14 in FIG. 1.

$$Fe_3O_4+8H^++2e^-\rightarrow 3Fe^{2+}+4H_2O \quad (6)$$

$$Fe_2O_3+3H^++2e^-\rightarrow 2Fe^{2+}+3OH^- \quad (7)$$

Figure 2D:
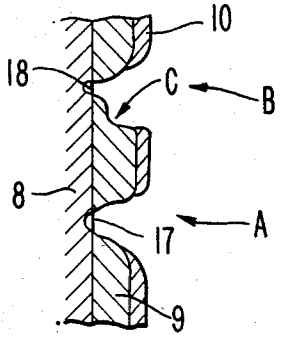
Figure 2E:
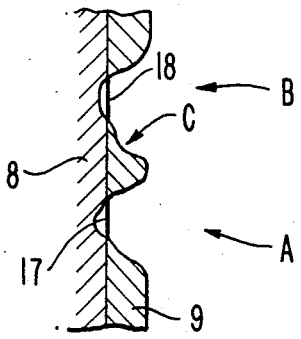

At those parts of the $Fe_3O_4$ layer 9 and $Fe_2O_3$ layer 10 lying in contact with the wash liquid which are other than the parts where the cathodic reaction is occurring, the dissolution of the iron oxide layers by the reactions of Formulae (1) and (3) is conducted. The rates of the dissolution processes of the iron oxide layers 9 and 10 involving such reducing reactions are markedly higher than the rates of the dissolution processes of Formulae (1) and (3) based on the acid. The ions $Fe^{3+}$ generated by Formulae (1) and (3) turn into the ions $Fe^{2+}$ on which the reducing agent has acted as indicated by Formula (2). In consequence of the reactions of Formulae (6) and (7), the iron oxides of the $Fe_3O_4$ layer 9 and $Fe_2O_3$ layer 10 at the part C are reduced and dissolved as illustrated in FIG. 2(D), and the dissolution rates of the iron oxides increase sharply. In other words, the anodic reaction in the surface of the metal iron 8 at the part A becomes active to that extent, and a pore 17 appears in the surface of the metal iron 8 due to the reaction of Formula (4). Even in the state of FIG. 2(D), the reactions of Formulae (1)–(7) take place. When the dissolution has further proceeded, the $Fe_2O_3$ layer 10 disappears entirely and only the $Fe_3O_4$ layer 9 is left behind as illustrated in FIG. 2(E). A pore 18 due to the anodic reaction arises also in the surface of the metal iron 8 at the part B. The reactions of Formulae (2)–(6) take place in the state of FIG. 2(E), and eventually the $Fe_3O_4$ layer 9 is completely dissolved and removed. The formation of the pores in the surface of the metal iron 8 as stated above means that the wall thickness of the pipe or the like decreases locally. Accordingly, there are such risks that the strength of the pipe or the like will lower and that the internal fluid will leak due to the appearance of a penetrating hole in the wall of the pipe. In order to avoid them, the corrosion of the parent material of the pipe or the like during the wash needs to be prevented.

As the result of study on the prior-art method of removing the iron oxides described above, phenomena as stated below are conjectured to occur. In general, electrons flow from an anodic reaction portion to a cathodic reaction portion. It is therefore conjectured that the electrons generated by the anodic reaction of the metal iron 8 at the part A will reach the cathodic reaction portions of the iron oxides at parts C and D through the interior of the metal iron 8 and will be used for the reactions of Formulae (6) and (7). On the basis of this phenomenon, the inventors have obtained the knowledge that when electrons are supplied from outside the parent material metal into the oxide layers unlike the electrons created by the reaction of the parent material metal, the reactions of Formulae (6) and (7) can be induced to remove the oxides without corroding the parent material metal. In addition, on the basis of FIG. 1, the inventors have obtained the knowledge that the corrosion of the parent material metal does not occur when the oxides adhering to the parent material metal are removed under the condition of the region 1 in which the oxides are in the thermodynamically unstable states and in which the parent material metal is in the thermodynamically stable state. This means to cause for $Fe_2O_3$ the change of shift from the region 3 to the region 1 as indicated by a straight line 19 in FIG. 1, and for $Fe_3O_4$ the change of shift from the region 2 to the region 1. The measure of bringing the oxides into the unstable region by shifting the potentials of the oxides in the base direction as indicated by the straight line 19 is equivalent to bringing the oxides into the unstable states by injecting electrons into the oxides. In case of utilizing the electron transfer process for the oxide dissolution phenomenon in this manner, the phenomenon can be understood well when the oxides are handled as semiconductors. To handle oxides as semiconductors is described, for example, by K. E. Heusler and K. S. Yan in 'Electron Transfer Reaction at Film covered Metal Electrodes', Electrochim. Acta. 22, 977 (1977) and by U. Stimming and J. W. Schultze in 'The Capacity Passivated Iron Electrodes and Band Structure of Passivity Layer', Berichte de Bunsen-Gesselschaft, 80, 1297 (1976).

Figure 3:
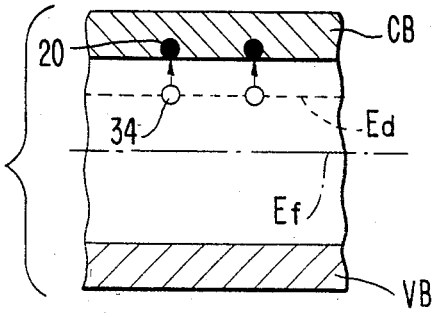
FIG. 3 is an explanatory diagram showing an iron oxide layer as a semiconductor model.

Since $Fe_3O_4$ can also be represented as $(FeO)Fe_2O_3$, it is an n-type semiconductor in which $Fe^{2+}$ is contained in $Fe_2O_3$ as an impurity (refer to the latter literature mentioned above). The semiconductor model of $Fe_3O_4$ expressed in terms of the $\kappa$-space (reciprocal space) is shown in FIG. 3. CB stands for a conduction band and VB a valence band, which are composed of the ions $Fe^{3+}$. The valence band VB contributes to the bond between iron and oxygen, while the conduction band CB permits electrons to move freely and concerns the electric conductivity. $Fe^{2+}$ being the impurity serves as a donor which supplies electrons 20 to the conduction band CB. The electrons 20 become free electrons which can freely move between the ions $Fe^{3+}$. A level Ed where the donor exists is an impurity level (donor level) at which $Fe^{2+}$ being the impurity exists. The donor level Ed is about 0.4 V nobler than the conduction band CB. When the thermal energy is applied, the electrons of the impurity are supplied to the conduction band CB. The impurity $Fe^{2+}$ having supplied the electrons becomes $Fe^{3+}$, and has positive holes 34 which accept electrons. While the Fermi level Ef exists between the conduction band CB and the donor level Ed at or near the room temperature, it shifts in the noble direction with rise in the temperature and finally comes to lie at the intermediate position between the conduction band CB and the valence band VB. A forbidden band in which the electrons cannot assume any energy level exists between the conduction band CB and the valence band VB.

Also the semiconductor model of $Fe_2O_3$ has a structure as shown in FIG. 3, but almost no $Fe^{2+}$ exists at the donor level Ed. The difference between the n-type semiconductors of $Fe_2O_3$ and $Fe_3O_4$ is the difference of the densities of the donor ions, and can be elucidated with models. The donor density of the latter $Fe_3O_4$ is higher than that of the former $Fe_2O_3$.

Figure 4:
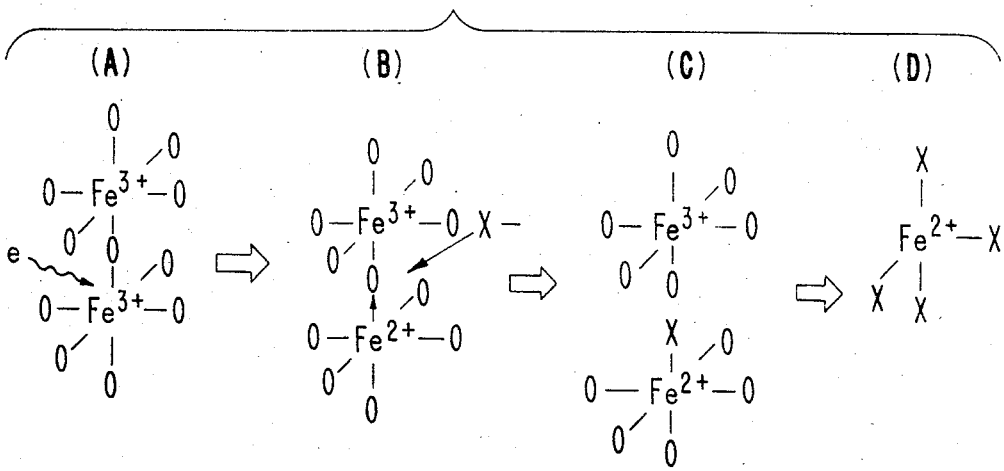
FIG. 4 is an explanatory diagram showing the dissolution phenomenon of iron oxides in terms of atoms.

Here, the phenomenon in which the oxides are liquated by receiving electrons will be described with reference to FIG. 4. The crystal lattice of $Fe_2O_3$ is isomorphous to that of corundum, and is partly shown in (A) of FIG. 4. $Fe_2O_3$ maintains its stable state with the atoms of $Fe^{3+}$ and $O^{2-}$ arranged as shown in (A) of FIG. 4. Letter O in FIG. 4 indicates $O^{2-}$. One electron $e^-$ migrating between the atoms of $Fe^{3+}$ and $O^{2-}$ as illustrated in (A) of FIG. 4 is supposed to have been received in one $Fe^{3+}$. The ion $Fe^{3+}$ changes to $Fe^{2+}$ by the reception of the electron. This signifies that the electron 20 enters the donor level Ed in FIG. 3. Here, when note is merely taken of electrostatic energy, $Fe^{2+}$ has a weaker bonding power with $O^{2-}$ as compared with $Fe^{3+}$. Further, $Fe^{3+}$ which undergoes a phenomenon to be stated below is firmly bound with six ions $O^{2-}$ by substantially equal powers and through six hands. In contrast, as regards $Fe^{2+}$, four of its six hands have high bonding powers with $O^{2+}$, but the remaining two hands have low bonding powers. The strengths of the bonding powers are always changing among the six hands of $Fe^{2+}$. When $Fe^{2+}$ has come into contact with the wash liquid, the complexing agent (for example, chelating agent) X contained in the wash liquid bonds with that one of the six hands of $Fe^{2+}$ which has the bonding power with $O^{2-}$. That is, as illustrated in (B) of FIG. 4, one hand of $Fe^{2+}$ (with a mark x in (B) of FIG. 4) having bonded with the adjoining $Fe^{3+}$ through $O^{2-}$ bonds with the complexing agent X when its bonding power with $O^{2-}$ has lowered. Therefore, the bond with $O^{2-}$ bonding with the adjoining $Fe^{3+}$ by the hand of $Fe^{2+}$ marked with $\Delta$ in (B) of FIG. 4 is severed as illustrated in (C) of FIG. 4. Such bonds between $Fe^{2+}$ and the complexing agent X are successively effected when the bonding powers between $O^{2-}$ and the six hands of $Fe^{2+}$ have lowered. When the complexing agent X has bonded with all the hands bonding with $O^{2-}$, a state as shown in (D) of FIG. 4 is established, and one ion $Fe^{2+}$ is separated from its bond with $Fe^{3+}$ constituting the crystal lattice and is liquated into the wash liquid. When one electron $e^-$ is injected into the other ion $Fe^{3+}$, the phenomenon as described above is repeated, and $Fe^{3+}$ turns into $Fe^{2+}$, which is liquated into the wash liquid. In this way, $Fe_2O_3$ is fully dissolved.

As also written $(FeO)Fe_2O_3$, $Fe_3O_4$ is constructed in such a manner that $Fe^{2+}$ and $Fe^{3+}$ bond through $O^{2-}$. That is, the crystal lattice of $Fe_3O_4$ corresponds to the state as depicted in (B) of FIG. 4. Since $Fe_3O_4$ contains $Fe^{2+}$ in its crystal lattice in advance, it is easier of dissolution than $Fe_2O_3$.

As expedients for injecting the electrons $e^-$ into the oxides as in FIG. 4, the following three methods are considered:

(1) Method wherein electrons are injected into oxides from the side of a parent material metal on the basis of the cathodic polarization (electron injection method based on the cathodic polarization).

(2) Method wherein the oxidation-reduction potential of a wash liquid is adjusted to inject electrons into oxides from a reducing agent contained in the wash liquid (electron injection method employing the reducing agent).

(3) Method wherein light is projected on oxides to obtain electrons of high energy level (electron injection method employing the light).

Hereunder, the respective methods will be described in detail in the order of (1), (2) and (3).

First, the electron injection based on the cathodic polarization will be referred to.

Figure 5:
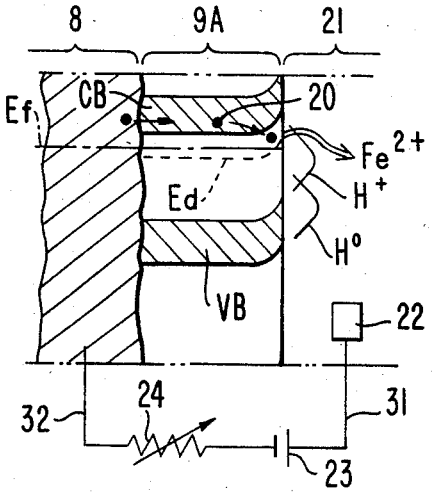
FIG. 5 is an explanatory diagram of a semiconductor model showing an electron injection method based on cathodic polarization which is an embodiment of this invention.

The principle of this method will be explained by taking as an example a case shown in FIG. 5 where an iron oxide layer is formed on the surface of carbon steel. As shown in FIG. 2(A), the $Fe_3O_4$ layer and $Fe_2O_3$ layer are formed on the surface of the metal iron 8. In FIG. 5, the $Fe_3O_4$ layer and $Fe_2O_3$ layer are collectively illustrated as the iron oxide layer 9A. Numeral 21 designates a wash liquid, in which a complexing agent is contained. An electrode 22 is immersed in the wash liquid 21. The plus side of a D.C. power source 23 is connected to the electrode 22 made of, for example, platinum, while the minus side of the power source 23 is connected to the metal iron 8 through a controller 24.

The electron injection method based on the cathodic polarization consists in that the potential of the surface of the iron oxide layer 9A is shifted in the base direction from the natural potential to a potential within the range of the region 1 in FIG. 1, whereby electrons generated by the anodic reaction of the platinum electrode 22 are supplied from the side of the metal iron 8 into the iron oxide layer 9A. $Fe^{3+}$ of the iron oxide layer 9A is reduced for dissolution into $Fe^{2+}$ under the action of the electrons as illustrated in (B) of FIG. 4, and the dissolution is promoted with the complexing agent. The metal iron 8 being the parent material is polarized so as to become lower than a cathode corrosion-protection potential. Preferably, the generation of hydrogen should be suppressed by making the wash liquid weakly acid to alkaline (a range of 4–9 in terms of pH). To be especially noted is that when a semiconductor is immersed in an aqueous solution, a special band structure appears in the vicinity of the surface thereof. More specifically, when the aqueous solution is neutral in pH and the natural potential is not higher than 0 V in the κ-space, the conduction band CB, valence bond VB and donor level Ed curve onto the base side in the surface of the semiconductor, for example, the surface of the iron oxide layer 9A shown in FIG. 5. Accordingly, an electric double layer is formed in the surface of the iron oxide layer 9A and hinders the liquation of metal ions, i. e., $Fe^{2+}$. However, the bands are flattened to facilitate the dissolution of the iron oxide layer 9A by injecting the electrons generated by the anodic reaction of the platinum electrode 22, into the iron oxide layer 9A as described above.

In this manner, in case where the cathodic polarization potential is the potential which renders the crystal structures of the oxides unstable and it is in an insensitive band in which the metal state is stabilized, for the parent material metal, that is, where it lies in the range of the region 1 in FIG. 1, both the dissolution of the oxides and the corrosion protection of the parent material metal are permitted.

Figure 6:
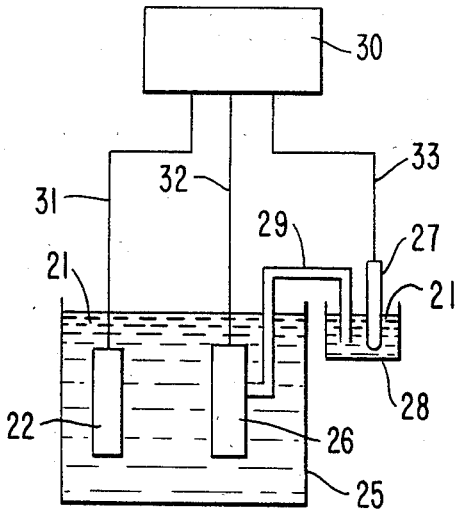
FIG. 6 is a structural diagram of a washing apparatus which is used for the electron injection method based on the cathodic polarization.

A practicable apparatus for performing this injection method based on the cathodic polarization is shown in FIG. 6. A platinum electrode 22 and an object to-be-washed 26 are immersed in a wash liquid 21 in a container 25. The platinum electrode 22 and the object to-be-washed 26 are connected to a potentiostat 30 by leads 31 and 32, respectively. Numeral 27 indicates a calomel electrode which is a reference electrode, and which is inserted in a container 28 filled with the wash liquid 21 and is connected to the potentiostat 30 by a lead 33. One end of a communicating tube 29 the other end of which is inserted in the container 28 is open in proximity to the surface of the object to-be-washed 26. The D.C. power source 23 and the controller 24 shown in FIG. 5 are assembled in the potentiostat 30.

Although an electrolyte, a pH regulating agent and a complexing agent in the wash liquid to be used in the present method are not particularly specified, organic compounds which can be dissolved to disappear at about 200° C. or above and nitrogen compounds such as ammonia and hydrazine are desirable for preventing the agents from remaining after the oxide removing operation. Such consideration is required especially in case of applying the present method to a nuclear power plant.

By way of example, polyaminocarboxylic acid salts such as triammonium citrate, diammonium oxalate ($(NH_4)_2C_2O_4$) and diammonium ethylenediaminetetraacetate are mentioned as compounds each of which serves both as the pH regulating agent and as the complexing agent.

Regarding the concentrations of the agents, there are not values especially restricted. However, when the complexing agent plays also the role of a supporting electrolyte, a concentration of at least 0.1 M/l is recommended in order to make the potential distribution uniform.

Hereunder will be described an example of experiment in which the effect of the present method carried out with the apparatus of FIG. 6 was confirmed. As a specimen being the object to-be-washed 26 from which an oxide was to be removed, there was used a pellet into which the powder of $Fe_3O_4$ was pressed and molded and which was bonded onto the surface of SUS 304 with an Ag paste. The pellet of $Fe_3O_4$ was covered with a sealing material, such as silicone resin, so that the exposed area thereof might become 1 $cm^2$. Used as the wash liquid 21 was the aqueous solution of diammonium oxalate ($(NH_4)_2C_2O_4$) which functioned as the pH regulating agent and the complexing agent. The concentration of diammonium oxalate was 0.1 M/l and the pH of the aqueous solution was approximately 6.5. The container 25 was filled with the aqueous solution as the wash liquid 21, and the specimen of SUS 304 with the $Fe_3O_4$ pellet mounted thereon and the platinum electrode 22 being the counter electrode were immersed in the wash liquid 21. The lead of the specimen was attached to the material SUS 304.

Subsequently, the cathodic polarization curve of $Fe_3O_4$ and the amount of dissolution of $Fe_3O_4$ were measured by fixing the surface potential of the $Fe_3O_4$ pellet at various values by the use of the potentiostat 30 and keeping the temperature of the wash liquid at 85° C. for 30 minutes.

Figure 8:
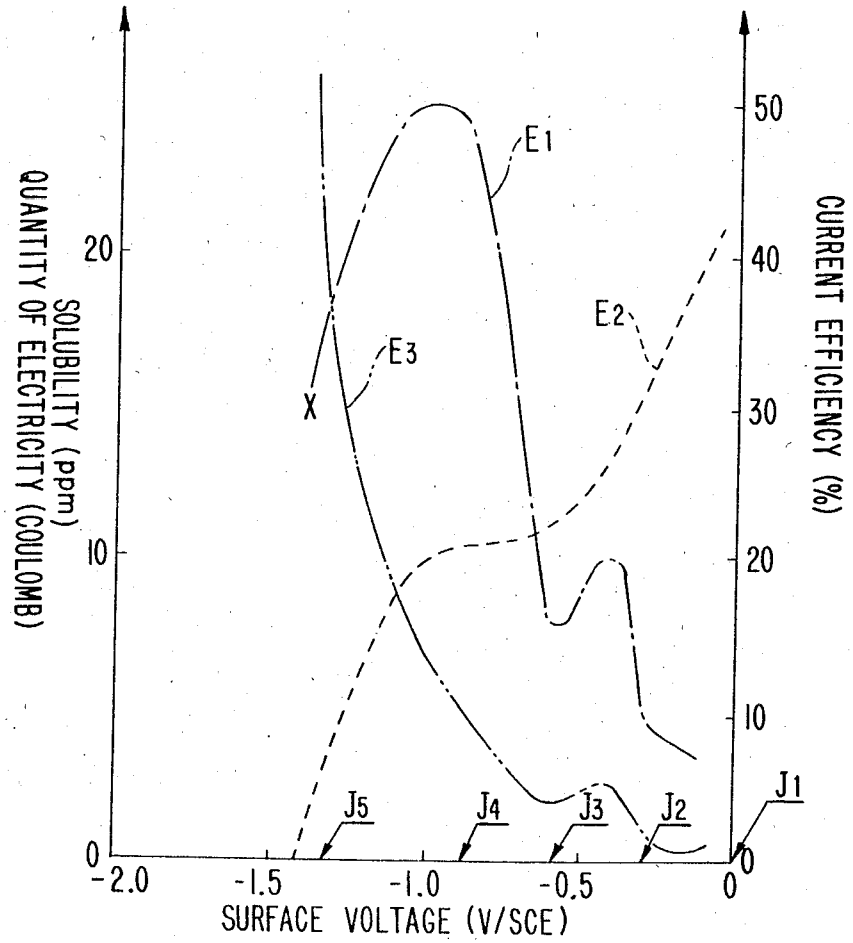
FIG. 8 is a graph showing the solubility of $Fe_3O_4$.
Figure 7:
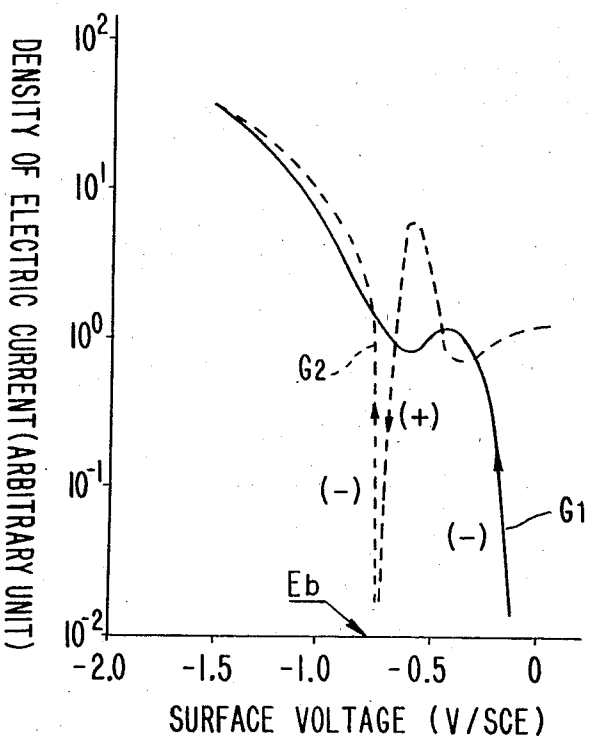
FIG. 7 is a graph of the cathodic polarization curves of $Fe_3O_4$ and carbon steel.

The cathodic polarization curve obtained by the measurement is shown in FIG. 7. A curve $G_1$ indicated by a solid line is the cathodic polarization curve of $Fe_3O_4$. The current density of the curve $G_1$ is indicated by absolute values, and actually assumed minus values. The potential on the axis of abscissas is the surface potential of the $Fe_3O_4$ pellet, and its values were measured by means of the calomel electrode 27. The surface potential of the $Fe_3O_4$ pellet could be varied by adjusting the controller 24 of the potentiostat 30. On the other hand, a curve $G_2$ indicated by a broken line is the cathodic polarization curve of carbon steel. Eb designates the equilibrium potential of the carbon steel which is substantially equal to the cathode corrosion-protection potential and at which the cathodic polarization curve of the carbon steel changes from plus to minus. The side on which the potential is higher than the cathode corrosion-protection potential Eb corresponds to the anodic polarization, while the side on which the potential is lower than the same corresponds to the cathodic polarization. In the region of the cathodic polarization, the values of the cathodic polarization curve of the carbon steel became minus. These polarization curves were measured by the constant-potential method. As seen from the cathodic polarization curve of $Fe_3O_4$, one maximum value exists in the vicinity of −0.4 V, and the current density increases below −0.6 V. FIG. 8 arranges and illustrates the amount of dissolution of $Fe_3O_4$. A curve $E_1$ in FIG. 8 indicates the solubility of $Fe_3O_4$, a curve $E_2$ the current efficiency, and a curve $E_3$ the quantity of electricity. As apparent from this figure, the solubility of $Fe_3O_4$ exhibits maximum values at surface potentials of approximately −0.4 V and approximately −1.0 V. The maximum value of the solubility at approximately −0.4 V corresponds to the maximum value of the cathodic polarization curve of $Fe_3O_4$ at approximately −0.4 V as shown in FIG. 7. In order to find the cause by which the solubility of $Fe_3O_4$ was reduced above approximately −1.0 V, an experiment of dissolution of $Fe_3O_4$ was conducted at a surface potential of −1.4 V, whereupon the $Fe_3O_4$ pellet was taken out and had its surface resistance measured. The resistance value of the $Fe_3O_4$ pellet surface decreased conspicuously as compared with that of $Fe_3O_4$. This fact signifies that $Fe^{2+}$ and $Fe^{3+}$ of $Fe_3O_4$ were reduced into metal iron ($Fe^0$).

The dissolution of the iron oxide layer 9A by the electron injection method based on the cathodic polarization is caused by a phenomenon as stated below. When a potential difference has arisen between the iron oxide layer 9A and the platinum electrode 22 in FIG. 5, the reaction of the following formula (8) takes place in the surface of the platinum electrode 22, to generate electrons $e^-$:

$$2OH^- \rightarrow \tfrac{1}{2}O_2 + H_2O + 2e^- \quad (8)$$

The electron $e^-$ is introduced into the metal iron 8 through the leads, and is finally supplied into the iron oxide layer 9A. As illustrated in FIG. 4, the externally supplied electron $e^-$ bonds with $Fe^{3+}$ to create $Fe^{2+}$. This ion $Fe^{2+}$ bonds with the complexing agent and is liquated into the wash liquid 21. Some of the electrons $e^-$ supplied to the iron oxide layer 9A give rise to the reaction of formula (5) in the surface of the iron oxide layer 9A.

Figure 9:
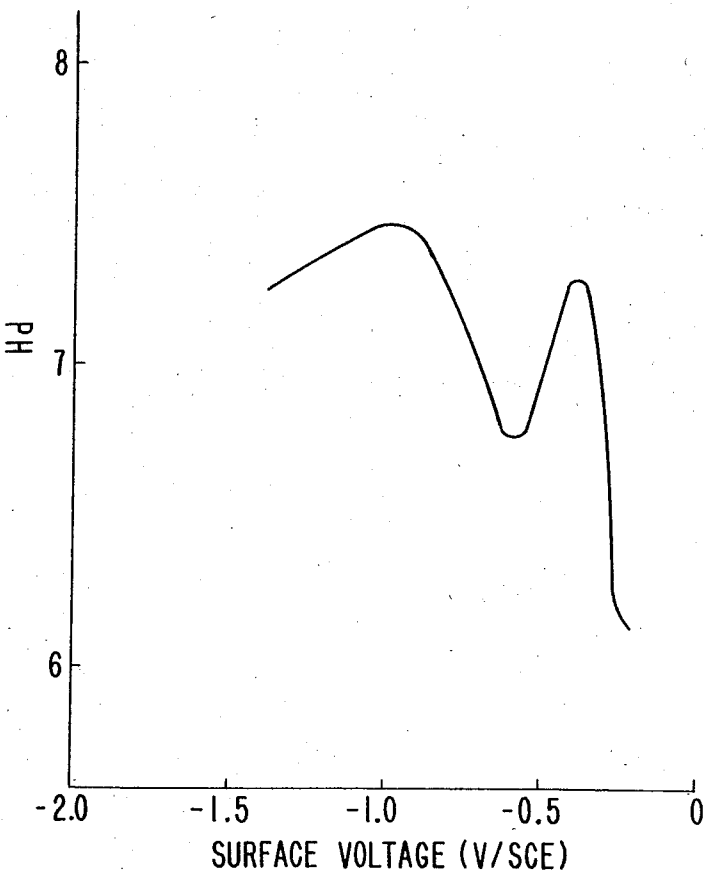
FIG. 9 is a graph showing the relationship between the surface potential of an $Fe_3O_4$ pellet and the pH of a wash liquid.

The variation of the pH of the wash liquid 21 at the time when $Fe_3O_4$ was dissolved at the constant potential as stated before, is shown in FIG. 9. At the surface potentials at which the solubility of $Fe_3O_4$ exhibits the maximum values, the pH of the wash liquid 21 shifts on the alkaline side. The pH of the wash liquid −1.0 V shifts on the alkaline side more than that at −1.4 V. It is accordingly demonstrated that the increase of the current density below −0.6 V is not attributed only to the reducing reaction of $H^+$ in the wash liquid ($2H^+ + 2e^- \rightarrow H_2$).

The fact that when the surface potential of $Fe_3O_4$ has become lower than −1.0 V, the solubility of $Fe_3O_4$ lowers in spite of the increase of the current density, is attributed to the reduction of $Fe^{2+}$ and $Fe^{3+}$ in $Fe_3O_4$ into $Fe^0$ and the increase of the amount of generation of hydrogen as stated previously. The increase of the amount of generation of hydrogen is also apparent from the fact that, in the region where the potential is lower than −1.0 V, the current efficiency decreases in spite of a remarkable increase in the quantity of electricity. The current efficiency is a value obtained in such a way that the quantity of electricity consumed for the dissolution of $Fe_3O_4$ is divided by the total quantity of electricity conducted.

The solubility of $Fe_3O_4$ is strongly dependent upon the potential, and has the maximum values in the two places as illustrated in FIG. 8. This is based on the fact that, as stated previously, $Fe^{3+}$ of $Fe_3O_4$ is reduced at the predetermined potentials, so the crystal structure of $Fe_3O_4$ becomes unstable due to the formation of $Fe^{2+}$ as shown in (B) of FIG. 4. That is, as described before, the reason will be that the ions $Fe^{2+}$ liable to solvation with the wash liquid appear during the reduction of the partly oxidized surface of $Fe_3O_4$ and during the reducing reaction ($Fe_3O_4 \rightarrow FeO$) or ($FeO \rightarrow Fe$). The liquation of $Fe^{2+}$ during the period during which the crystal structure of $Fe_3O_4$ is unstable is dependent strongly upon the complexing agent in the wash liquid. The solubilities of $Fe_3O_4$ obtained using aqueous solutions which contained 0.1 M/l of triammonium citrate and ethylenediaminetetraacetic acid (EDTA) as the complexing agents are listed in Table 1 as to surface potentials of −0.6 and −1.0 V.

TABLE 1

| | Triammonium citrate | EDTA |
|---|---|---|
| −0.6 V | 7 ppm | 11 ppm |
| −1.0 V | 41 ppm | 25 ppm |

Further, the cathodic polarization curve of $Fe_3O_4$ obtained when an $Na_2SO_4$ aqueous solution of low complexing capability was used as the wash liquid exhibited no maximum value at −0.4 V. The solubility of $Fe_3O_4$ at −0.6 V was about 8 ppm with a diammonium oxalate aqueous solution, but it was lower than 0.1 ppm with the $Na_2SO_4$ aqueous solution. It has been known from these results that the complexing agent greatly affects the dissolution rate.

From such experimental results, it has been revealed that the dissolution of the iron oxides can be efficiently executed even with potentials which are not higher than the foregoing cathode corrosion-protection potential Eb (= −0.7 V) of the carbon steel and at which the carbon steel can stably exist in the state of metal. There will now be described a practicable embodiment of the electron injection method exploiting the cathodic polarization as based on the above knowledge. The dissolution of the iron oxide layer 9A is carried out as below stated by the use of the apparatus shown in FIG. 6. An aqueous solution containing 0.1 M/l of diammonium oxalate (6.5 in terms of pH) is used as the wash liquid 21, the controller 24 of the potentiostat 30 is adjusted so that the surface potential of the iron oxide layer 9A of the object to-be-washed (for example, the fuel assembly of a boiling water reactor or the impeller of a pump in a recirculating system) 26 may become −1.0 V, and this surface potential is held for a predetermined period of time. Thus, the iron oxide layer 9A adherent on the object to-be-washed 26 can be completely dissolved and removed. This is based on the fact that the electrons generated by the anodic reaction of the platinum electrode 22 are supplied to the iron oxide layer 9A as described before. Even during the dissolution of the iron oxide layer 9A, the metal iron (for example, carbon steel) 8 being the parent material of the object to-be-washed 26 does not corrode. Even when the iron oxide layer 9A is dissolved until the wash liquid comes into contact with the metal iron 8, the surface potential of the metal iron 8 is lower than −1.0 V. The surface potential of the iron oxide layer 9A may well become equal to or higher than the cathode corrosion-protection potential of the metal iron 8 being the parent material (in case of the carbon steel, −0.7 V when the pH of the wash liquid is 6.5). However, the surface potential of the iron oxide layer 9A needs to be adjusted so that when the wash liquid 21 comes into contact with the metal iron 8, the potential of the metal iron 8 may lie within the range of the region 1 in FIG. 1. The phenomenon in which the potential of the surface of the iron oxide layer 9A becomes higher than the potential of the metal iron 8 being the parent material in the structure of FIG. 5 can naturally occur on account of the electric resistance of the iron oxide layer 9A.

Figure 10A:
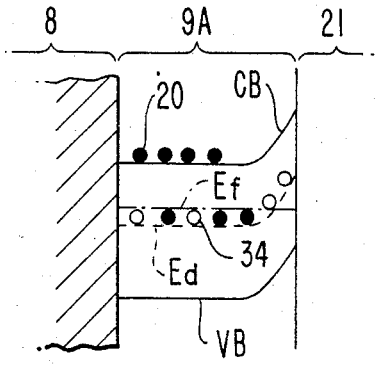
FIGS. 10(A), 10(B), 10(C), 10(D) and 10(E) are explanatory diagrams for elucidating the dissolution phenomenon of $Fe_3O_4$ with a semiconductor model.
Figure 10B:
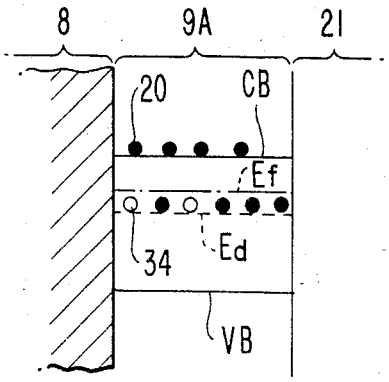

The dissolution phenomenon of $Fe_3O_4$ illustrated in FIG. 8 will be described with reference to the semiconductor model shown in FIG. 5. As set forth previously, when a semiconductor is immersed in an aqueous solution, an electric double layer is formed in the surface of the semiconductor. For this reason, when the wash liquid 21 is neutral (pH of 6.5 in the present embodiment) and the natural potential is 0 V or below, the conduction band CB, valence band VB and donor level Ed curve in the base direction in the surface of the iron oxide layer 9A as illustrated in FIG. 10(A). This indicates that the electric double layer is formed in the surface of the iron oxide layer 9A and that a barrier which hinders the liquation of $Fe^{2+}$ of the iron oxide layer 9A is formed. FIG. 10(A) corresponds to a state $J_1$ in FIG. 8. Referring to FIGS. 10(A)–10(E), there will be described how the band structure of the iron oxide layer 9A changes and how the changes concern the dissolution phenomenon of $Fe_3O_4$ when the iron oxide layer 9A is subjected to the cathodic polarization in the state in which the bands (indicative of the conduction band GB, the valence band VB, etc.) curve in the base direction as described above. The minus side of the D.C. power source 23 is connected to the metal iron 8 and the plus side thereof to the platinum electrode 22 as shown in FIG. 5, whereupon the controller 24 of the potentiostat 30 is operated to raise the potential of the platinum electrode 22. In the surface of the platinum electrode 22, the anodic polarization occurs and the reaction of Formula (8) takes place. The electrons generated in the platinum electrode 22 by the reaction of Formula (8) are introduced into the metal iron 8 through the leads 31 and 32 which hold the metal iron 8 and the platinum electrode 22 in communication and with which the D.C. power source 23 and the controller 24 are connected. The energy level of the electrons supplied externally and accumulated in the metal iron 8 is raised above the energy level of the conduction band CB of the iron oxide layer 9A by the supply of energy from the D.C. power source 23. At this time, free electrons 20 in the metal iron 8 enter the iron oxide layer 9A. While some of the free electrons 20 supplied from the metal iron 8 to the iron oxide layer 9A are entering the holes 34 of the donor level Ed existent on the metal iron 8 side of the iron oxide layer 9A and are being supplied from the donor level Ed to the conduction band CB by heat energy, they migrate between $Fe^{3+}$ and $O^{2+}$ as shown in (A) of FIG. 4 and enter the holes 34 in the front surface of the iron oxide layer 9A where the electric double layer is formed. By the entry of the free electrons 20 into the holes 34, the ions $Fe^{2+0}$ whose bond state with the ions $Fe^{3+}$ is unstable are created in the surface of the iron oxide layer 9A as illustrated in (B) of FIG. 4. The ion $Fe^{2+}$ bonds with the complexing agent as shown in (C) of FIG. 4, and is liquated into the wash liquid 21. Some of the free electrons 20 supplied from the metal iron 8 to the iron oxide layer 9A reach the front surface of the iron oxide layer 9A, and generate $H_2$ by causing the reaction indicated by Formula (5) with $H^+$ contained in the wash liquid. This signifies that, in the surface of the iron oxide layer 9A, the cathodic polarization occurs to cause the cathodic reaction. By subjecting the iron oxide layer 9A to the cathodic polarization in this manner, the electron injection into $Fe^{3+}$ takes place, and the bands flatten as shown in FIG. 10(B). This corresponds to a potential $J_2$ in FIG. 8. At this time, the barrier against the liquation of $Fe^{2+}$ becomes small, and $Fe^{2+}$ becomes easy of dissolution in the wash liquid 21.

Figure 10C:
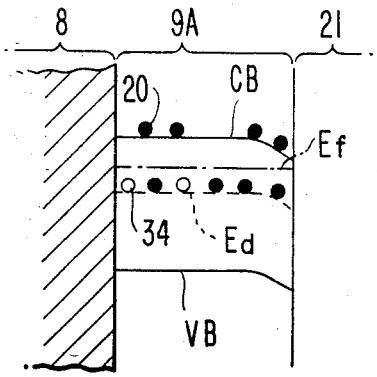

Further, the controller 24 is operated to apply energy to large quantities of free electrons 20 within the metal iron 8, whereby the amount of the free electrons 20 to be supplied into the iron oxide layer 9A increases to promote the cathodic polarization. Thus, the bands curve onto the noble side as shown in FIG. 10(C). This corresponds to $J_3$ in FIG. 8. The surface of the iron oxide layer 9A becomes easy of reduction, resulting in the possibility that the liquation of $Fe^{2+}$ will increase. Since, however, a barrier is formed against the liquation of $Fe^{2+}$ due to the execution of the cathodic polarization, the rate of increase of $Fe^{2+}$ decreases conversely.

Figure 10D:
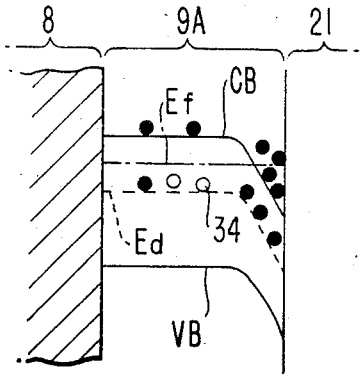

Subsequently, when the quantity of the free electrons 20 to be supplied to the iron oxide layer 9A increases with the lowering of the potential of the metal iron 8, the curves of the bands in the surface of the iron oxide layer 9A become still sharper. As seen in FIG. 10(D) (corresponding to $J_4$ in FIG. 8), therefore, the conduction band CB comes into the nobler side than the Fermi level (Ef) in the surface of the iron oxide layer 9A. For this reason, the reduction reaction of $Fe^{3+}$ in the surface of the iron oxide layer 9A proceeds greatly. As a result, the quantity of the ions $Fe^{2+}$ which go beyond the barrier to be liquated increases. There are also processes in which the ions $Fe^{2+}$ turn into iron ($Fe^{O}$) to be dissociated from the surface of the iron oxide layer 9A, and in which some of dissociated ions $Fe^{2+}$ turn into $Fe^0$ and then pass the barrier at the interface. In this case, $Fe^0$ is unstable in the aqueous solution of a bulk and therefore becomes $Fe^{2+}$ again. As a result, the dissolution of the iron oxides progresses as a whole.

When the anodic polarization occurs in the surface of the platinum electrode 22, the cathodic polarization occurs in the surface of the iron oxide layer 9A. Due to the occurrence of the cathodic polarization, the potential of the metal iron 8 being the parent material becomes equal to or lower than the cathode corrosion-protection potential and lies in the base direction with respect to the Fermi level Ef. Accordingly, the corrosion of the metal iron 8 can be prevented during the dissolution of the iron oxide layer 9A by utilizing the cathodic polarization of the iron oxide layer 9A. Such state indicates that the energy level of the free electrons 20 which are supplied from the metal iron 8 to the iron oxide layer 9A is made the Fermi level Ef or higher by the supply of the energy from the D.C. power source 23. The Fermi level Ef represents the energy level of that point between the valence band VB and the conduction band CB at which the probability of the presence of an electron is ½. In case where the parent material metal is stainless steel, the corrosion of the stainless steel can be prevented by holding the potential of the stainless steel at or below the cathode corrosion-protection potential thereof. The cathode corrosion-protection potential of the stainless steel is higher than that of the carbon steel.

Figure 10E:
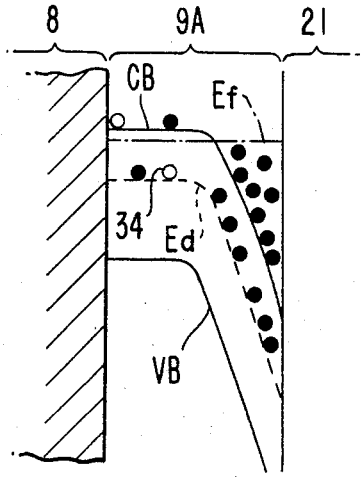

Lastly, when the cathodic polarization is excessively performed as illustrated in FIG. 10(E) (corresponding to $J_5$ in FIG. 8), the dissociated atoms $Fe^0$ increase in the vicinity of the surface of the iron oxide layer 9A. For this reason, the atoms $Fe^0$ flocculate one another, and fine grains of iron are formed. The fine grains do not dissolve in the wash liquid 21, and therefore settle and precipitate on the surface of the iron oxide layer 9A.

By adding into the wash liquid the complexing agent bearing minus charges, the plus charges of $Fe^{2+}$ are canceled, and the reduction of $Fe^{2+}$ into the metal state is restrained, so that the maximum value of the solubility of $Fe_3O_4$ becomes still greater.

In case of dissolving the oxides by the electron injection method based on the cathodic polarization, the reduction of $H^+$ into hydrogen is attendant as described before. The generation of hydgrogen, however, can be restrained by adjusting the pH of the wash liquid 21 into a range of from neutrality to weak alkalinity (pH=4–9). As a result, the current efficiency is enhanced, and the danger of the dehydrogenation of the parent material metal lessens.

Figure 11:
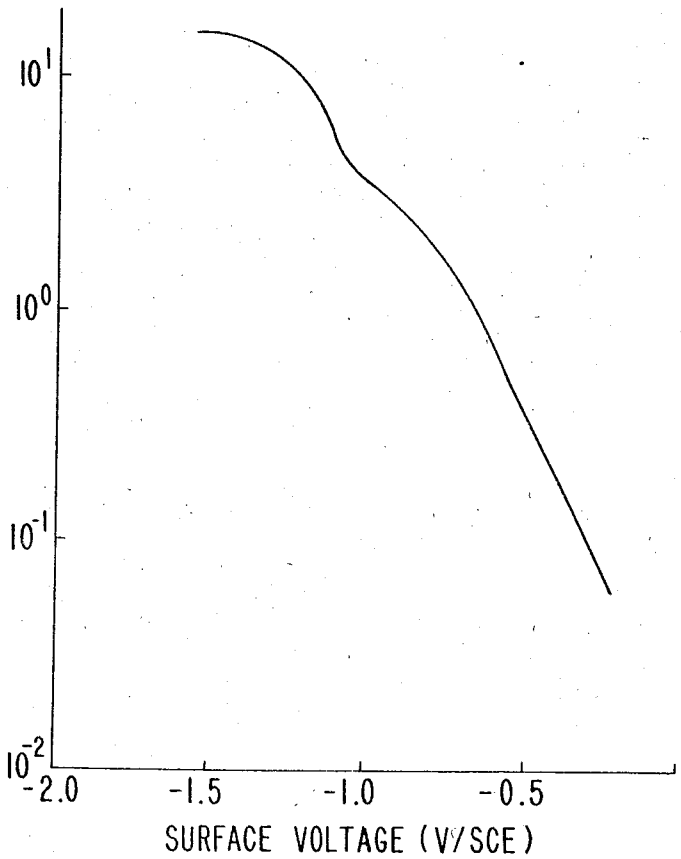
FIG. 11 is a graph of the cathodic polarization curve of $NiFe_2O_4$.
Figure 12:
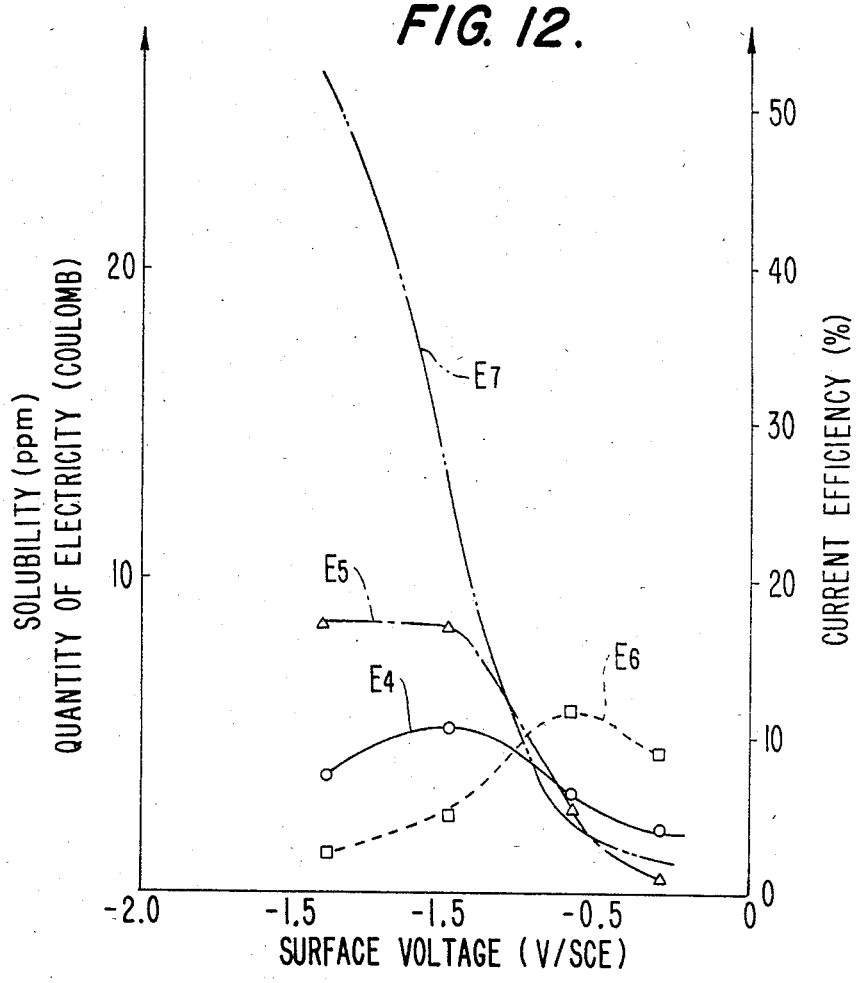
FIG. 12 is a graph showing the solubility of $NiFe_2O_4$.

Next, using a pellet of $NiFe_2O_4$ being the oxide of stainless steel instead of the $Fe_3O_4$ pellet, the dissolution state was confirmed with the apparatus shown in FIG. 6. As the wash liquid 21, the aqueous solution of diammonium oxalate at 0.1M/l was employed as in the case of FIG. 7. FIG. 11 shows the cathodic polarization curve of $NiFe_2O_4$. Unlike the case of $Fe_3O_4$, the current density rises with decrease in the surface potential of the $NiFe_2O_4$ pellet, and the maximum value exists at −1.0 V. FIG. 12 shows the solubilities of $Ni^{2+}$ and $Fe^{2+}$. The solubility of $Ni^{2+}$ is indicated by a curve $E_4$, and that of $Fe^{2+}$ by a curve $E_5$. A curve $E_6$ represents the current efficiency, and a curve $E_7$ the quantity of electricity. The solubilities of $Ni^{2+}$ and $Fe^{2+}$ become maximal at −1.0 V at which the maximum value exists in the cathodic polarization curve.

From the above results, also in case of removing $NiFe_2O_4$ formed on the surface of stainless steel, the apparatus shown in FIG. 6 is used, and the potential of the surface of the Ni oxide is adjusted with the potentiostat 30 so as to become −1.0 V which is not higher than the cathode corrosion-protection potential. Electrons which are generated by the anodic reaction caused in the platinum electrode 22 under the action of the D.C. power source 23 are supplied from the parent material metal into the Ni oxide. Thus, the oxide $NiFe_2O_4$ falls into an unstable state as in the foregoing case of $Fe_3O_4$ and turns into $Ni^{2+}$ and $Fe^{2+}$ under the action of the complexing agent, to be liquated into the wash liquid. Also in the case where the oxide is $NiFe_2O_4$, the phenomena illustrated in FIGS. 10(A)–10(E) occur in succession. In particular, at the surface potential −1.0 V of the Ni oxide at which the phenomenon of FIG. 10(D) occurs, the solubility of the oxide becomes maximal.

The electron injection method based on the cathodic polarization injects into the oxide the electrons which have energy levels higher than the Fermi level and which are generated by the anodic reaction of the electrode immersed in the wash liquid as caused on the basis of the energy applied from the D.C. power source being the external power source. Therefore, the parent material metal can be reliably prevented from corroding, and moreover, the oxide can be efficiently disssolved. At this time, the potential of the parent material metal is a potential within the range of the region 1 of FIG. 1, that is, a potential in the region where the parent material metal is stable.

Now, the second electron injection method employing a reducing agent will be described.

Figure 13:
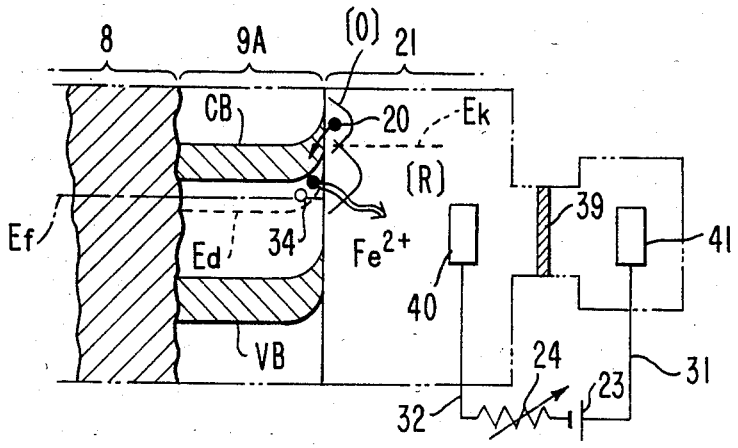
FIG. 13 is an explanatory diagram of a semiconductor model showing an electron injection method employing a reducing agent which is another embodiment of this invention.

First, a case where electrons are injected into oxides on the surface of an object to-be-washed from a reducing agent contained in a wash liquid will be explained with reference to FIG. 13. In order to inject electrons 20 from a reducing agent in a wash liquid 21 into oxides, for example, an iron oxide layer 9A, the oxidation-reduction potential Ek of the reducing agent needs to lie on the base side with respect to the Fermi level Ef of the iron oxide layer 9A as shown in FIG. 13. Further, it is needed that the state distribution of the reducer [R] of the reducing agent and the state distribution of energy levels. to accept the electrons of the iron oxide layer 9A (for example, the conduction band CB and the donor level Ed at which positive holes 34 exist are considered) overlap each other. That is, the migration of the electrons 20 takes place for the first time when the overlap of the wave functions of the two exists.

The oxidation-reduction potential Ek is defined as in the following expression:

$$Ek = Eo + K \ln [O]/[R] \quad (9)$$

Here, Eo denotes a reference oxidation-reduction potential, K a constant, [O] the concentration of an oxidizer in the wash liquid, and [R] the concentration of the reducer in the wash liquid.

In case where the reducing agent is dissolved in a solution, the oxidizer [O] is usually existent in the solution because part of the reducing substance is oxidized. Accordingly, the oxidation-reduction potential Ek shifts in the noble direction with respect to the Fermi level Ef of the iron oxide layer 9A. In order to move the oxidation-reduction potential Ek in the base direction with respect to the Fermi level Ef, the oxidizer [O] in the wash liquid is converted onto the reducer [R] by the electrolysis of the wash liquid 21. The electrolysis of the wash liquid 21 is effected between a reduction electrode (platinum electrode) 40 which is immersed in the wash liquid 21 and a counter electrode (platinum electrode) 41 which opposes to the reduction electrode 40 through a cation-exchange film 39. The reduction electrode 40 and the counter electrode 41 are connected by leads 31 and 32 through a D.C. power source 23 and a controller 24. The reduction electrode 40 is connected on the minus side of the D.C. power source 23, and the counter electrode 41 on the plus side thereof.

The reduction of the oxidizer [O] of the wash liquid 21, that is, the conversion of the oxidizer [O] into the reducer [R] is executed in such a way that upon causing current to flow between the reduction electrode and the counter electrode, the oxidizer [O] combines with an electron supplied from the reduction electrode.

$$[O]+e^- \rightarrow [R] \quad (10)$$

By reducing the oxidizer [O] to create the reducer [R] in this manner, the oxidation-reduction potential Ek of the wash liquid 21 shifts in the base direction beyond the Fermi level Ef of the iron oxide layer 9A, and the electron 20 can be directly injected from the reducer in the wash liquid 21 into the conduction band CB of the iron oxide layer 9A. The electron 20 injected into the iron oxide layer 9A enters the hole 34 of the donor level Ed eventually and becomes stable in energy. This indicates that $Fe^{3+}$ is reduced into $Fe^{2+}$ as in (B) of FIG. 4. Here the complexing agent contained in the wash liquid 21 acts as illustrated in FIG. 4, so that $Fe^{2+}$ is liquated.

Although the reducing agent to be used in the present method is not especially specified, one whose reference oxidation-reduction potential lies on the cathode side to the utmost is desirable. For example, in case of organic substances, there are mentioned L-ascorbinic acid, riboflavin, rose Bengal and rhodamine B. As inorganic substances, there are $Cr^{2+}$, $Sn^{2+}$ etc. In order to prevent such reducing agent from remaining after the dissolution and removal of the oxides, an organic substance which can be decomposed to disappear at a high temperature of or above approximately 208° C. is suitable as the reducing agent. Suitable as the complexing agents are the substances which have been used in the electron injection method based on the cathodic polarization.

When the electrons are injected from the reducer [R] into the iron oxide layer 9A, the reducer [R] changes into the oxidizer [O]. In consequence, the quantity of the oxidizer [O] in the wash liquid 21 increases, and the oxidation-reduction potential Ek of the wash liquid 21 shifts in the noble direction. Since, however, the oxidizer [O] is supplied with the electrons from the reduction electrode 40 and changes into the reducer [R] as stated before, the iron oxide layer 9A can be dissolved without making the concentration of the reducing agent in the wash liquid 21 higher than is required.

Figure 14:
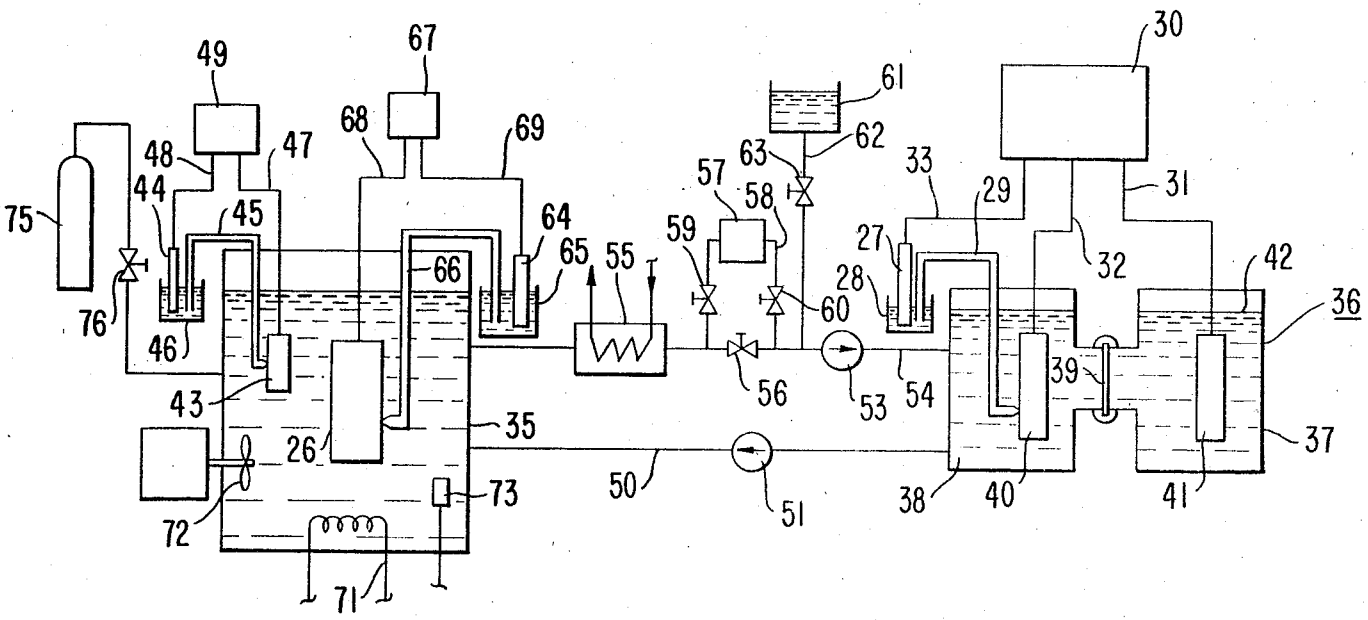
FIG. 14 is a flow diagram of a washing apparatus which is applied to the electron injection method employing the reducing agent.

An apparatus which is used for the electron injection method employing the reducing agent is shown in FIG. 14. The iron oxide removing apparatus used for the present method is constructed of a dissolution tank 35 which is filled with a wash liquid 21, an electrolysis tank 36 which has an anode chamber 37 and a cathode chamber 38 separated by a cation exchange film 39, a reduction electrode (platinum electrode) 40 which is immersed in the wash liquid 21 in the cathode chamber 38, a counter electrode (platinum electrode) 41 which is immersed in a liquid 42 in the anode chamber 37, and a potentiostat 30. The reduction electrode 40 and the counter electrode 41 are respectively connected to the potentiostat 30 by leads 32 and 31. A D.C. power source and a controller are connected to the leads 31 and 32. That end of a communicating tube 29 which is inserted in the cathode chamber 38 is open in proximity to the surface of the reduction electrode 40.

The dissolution tank 35 and the cathode chamber 38 are held in communication by pipes 50 and 54 having pumps 51 and 53 respectively. A cooler 55 is disposed in the pipe 54. An object to-be-washed 26 is immersed in the wash liquid 21 of the dissolution tank 35. A calomel electrode 64 is inserted in a container 65 held in communication with the dissolution tank 35 by a communicating tube 66 which has at its one end an opening proximate to the surface of the object to-be-washed 26. The object to-be-washed 26 and the calomel electrode 64 are respectively connected to a potentiometer 67 by leads 68 and 69. Further, a platinum electrode 43 is inserted in the dissolution tank 35, while a calomel electrode 44 is inserted in a container 46 held in communication with the dissolution tank 35 by a communicating tube 45 which has one end open in proximity to the platinum electrode 43. The platinum electrode 43 and the calomel electrode 44 are respectively connected to a potentiometer 49 by leads 47 and 48.

The anode chamber 37 is filled with an oxalic acid solution of 0.5M/l. Used as the wash liquid 21 is an aqueous solution which contains 0.002M/l of L-ascorbinic acid and 0.002M/l of EDTA (Na). As in the electron injection method based on the cathodic polarization, the object to-be-washed 26 is of SUS 304 and has an $Fe_2O_3$ pellet bonded thereto. The lead 68 is connected to the material SUS 304. The wash liquid 21 is heated to 85° C. and held at the temperature by a heater 71. By opening a valve 76, $N_2$-gas is spouted from a bomb 75 into the wash liquid 21 so as to deaerate the wash liquid. The deaeration is also carried out in the electron injection method based on the cathodic polarization. A pH-electrode 73 connected to a pH-meter is immersed in the wash liquid 21 so as to detect the pH of the wash liquid. The wash liquid 21 in the dissolution tank 35 is introduced into the cathode chamber 38 through the pipe 54 by driving the pump 53. At that time, the wash liquid 21 is cooled by the cooler 55. Current flows between the reduction electrode 40 and the counter electrode 41 under the action of the D.C power source (within the potentiostat 30). Owing to the current conduction, the reaction of Formula (8) occurs in the surface of the counter electrode 41 of the anode chamber 37. Electrons generated in the counter electrode 41 flow from the lead 31 to the lead 32, and reach the reduction electrode 40. The oxidizer [O] in the wash liquid 21 is reduced into the reducer [R] by the electrons. The proportion of the conversion from the oxidizer [O] into the reducer [R] can be adjusted in such a way that the potential difference between the reduction electrode 40 and the counter electrode 41 is adjusted by adjusting the controller (within the potentiostat 30). Unless the potential difference is great, the proportion increases. Further, the reaction of Formula (5) occurs partly in the surface of the reduction electrode 40, to generate $H_2$. The wash liquid 21 with the oxidizer [O] decreased returns into the dissolution tank 35 through the pipe 50. The surface potential of the reduction electrode 40 is measured by a calomel electrode 27 which is connected to the potential 30 by a lead 33. Further, the surface potential of the iron oxide layer 9A of the object to-be-washed 26 is measured by the calomel electrode 64 and the potentiometer 67. Further, the oxidation-reduction potential Ek of the wash liquid 21 in the dissolution tank 35 is measured by the platinum electrode 43, the calomel electrode 44 and the potentiometer 49. By operating the controller of the potentiostat 30, the potential to be applied to the reduction electrode 40 is adjusted so that the oxidation-reduction potential Ek may lie in the base direction beyond the Fermi level Ef of the iron oxide layer 9a of the object to-be-washed 26, for example, that it may shift in the base direction beyond the surface potential of the iron oxide layer 9A. As described previously, accordingly, electrons are injected from the reducer [R] in the wash liquid 21 into the iron oxide layer 9A of the object to-be-washed 26. The energy levels of the electrons are higher than the Fermi level Ef. By the injection of the electrons, $Fe^{3+}$ close to the surface of the iron oxide layer 9A is reduced into $Fe^{2+}$. The bond between $Fe^{2+}$ and $O^{2-}$ is in the unstable state as shown in (B) of FIG. 4, and the iron $Fe^{2+}$ is liquated into the wash liquid 21 by bonding with the complexing agent. In this way, the iron oxide layer 9A is dissolved from the surface. Also in the electron injection method employing the reducing agent, the phenomena in FIGS. 10(A)–10(E) appear in succession as the potential difference arising between the reduction electrode 40 and the counter electrode 41 is increased. When the potential difference at which the phenomenon of FIG. 10(D) occurs has arisen between the reduction electrode 40 and the counter electrode 41, the solubility of the iron oxide layer 9A becomes maximal.

Figure 15:
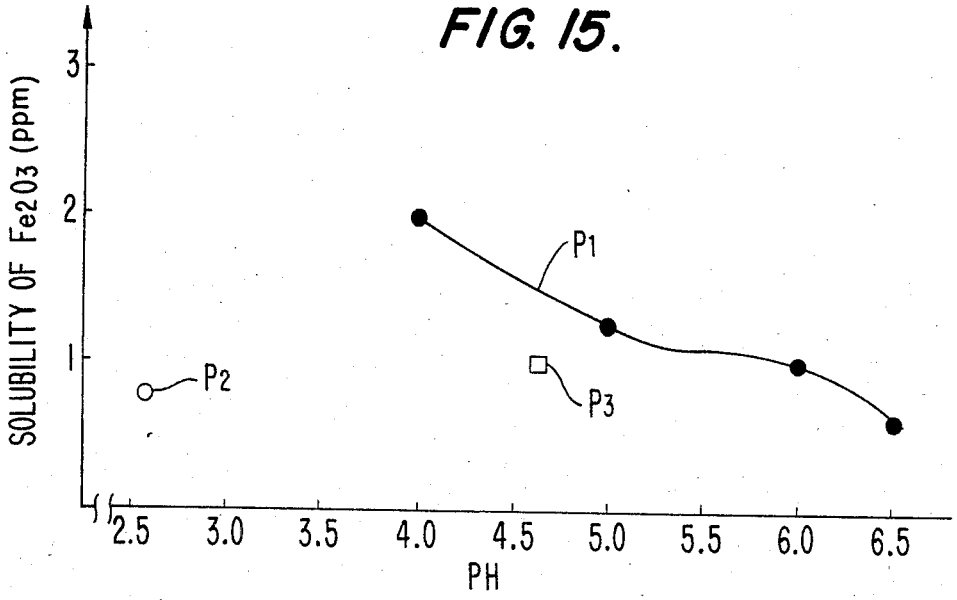
FIG. 15 is a graph showing the relationship between the pH of a wash liquid and the solubility of $Fe_2O_3$.

Shown in FIG. 15 is an experimental result obtained when, using the apparatus shown in FIG. 14, the $Fe_2O_3$ pellet was immersed as previously stated in a mixed aqueous solution which was the wash liquid and which consisted of 0.002M/l of L-ascorbinic acid and 0.002M/l of sodium ethylenediaminetetraacetate [EDTA(Na)], the mixed aqueous solution mentioned above was reduced and the $Fe_2O_3$ pellet was dissolved for 1 hour. A curve $P_1$ indicates the result. L-ascorbinic acid was the reducing agent, while EDTA(Na) was the complexing agent. The experiment was conducted by variously changing the pH of the mixed aqueous solution mentioned above. The oxidation-reduction potential Ek of the mixed aqueous solution in the dissolution tank 35 was measured by the platinum electrode 43, calomel electrode 44 and potentiometer 49. This oxidation-reduction potential Ek was held at −0.75 V by adjusting the potential difference between the reduction electrode 40 and the counter electrode 41 by operating the controller. The natural potential of carbon steel under the same condition was −0.8 V. These potentials were baser than the Fermi level, approximately −0.7 V of $Fe_2O_3$.

Notwithstanding that the concentration of the reducing agent in the wash liquid in the present example is markedly low, the solubility of $Fe_2O_3$ increases sharply as apparent from the curve $P_1$. This becomes obvious by comparing the solubility of $Fe_2O_3$ with that in the case of employing a different reducing agent. $P_2$ indicates the solubility of $Fe_2O_3$ at the time when Citrox (a mixed solution consisting of 0.3M/l of oxalic acid and 0.2M/l of diammonium citrate) was used as the reducing agent. $P_3$ indicates the solubility of $Fe_2O_3$ at the time when 0.48M/l of diammonium citrate was used as the reducing agent. The experimental results $P_2$ and $P_3$ correspond to a case where the oxidizer produced in the wash liquid by adding the reducing agent is not reduced. In this manner, the solubility of $Fe_2O_3$ in the present example increases. Moreover, the potential of the metal iron 8 of the parent material is −0.8 V, which is lower than the cathode corrosion-protection potential of carbon steel, so that the corrosion of the parent material can be prevented. In case where the wash liquid containing 0.48M/l of diammonium citrate at $P_3$ is electrolytically reduced as in the present example, the solubility of $Fe_2O_3$ increases. According to the present method, when the iron oxide layer 9A has been dissolved to bring the wash liquid into contact with the parent material metal, the surface potential of the parent material metal is a potential in the region 1 of FIG. 1 where the metal is stable.

Figure 16:
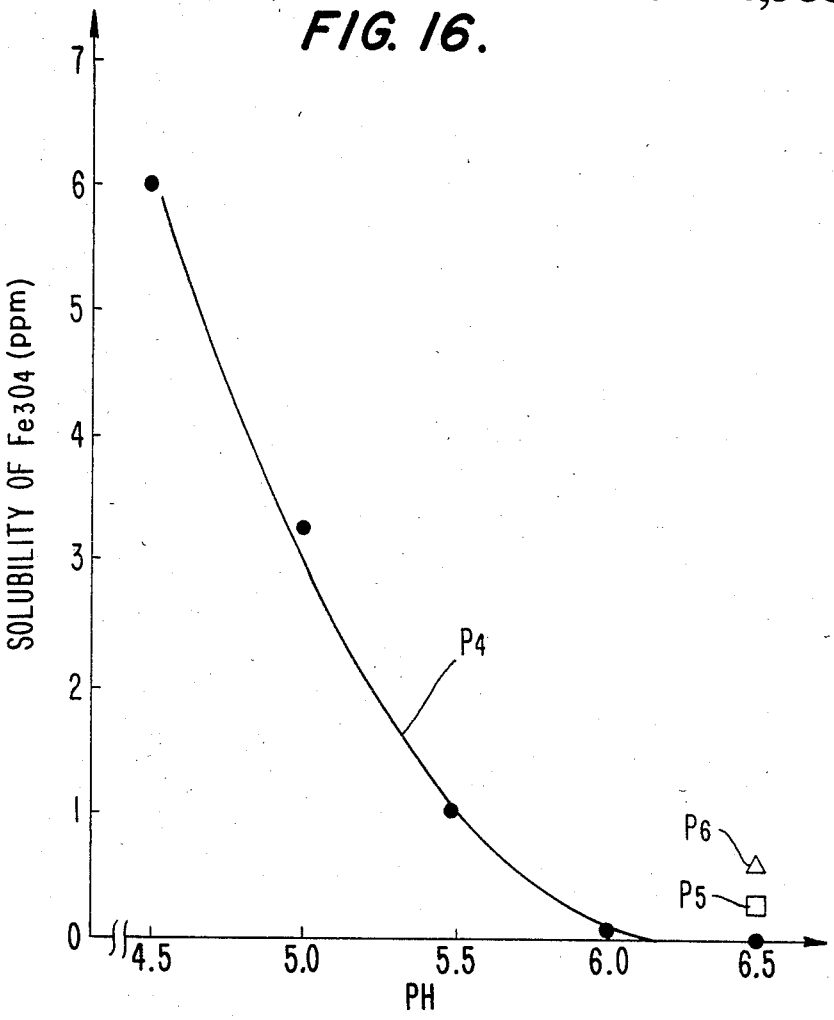
FIG. 16 is a graph showing the relationship between the pH of a wash liquid and the solubility of $Fe_3O_4$.

FIG. 16 shows an experimental result obtained when the $Fe_2O_3$ pellet was replaced with an $Fe_3O_4$ pellet, which was dissolved under the same experimental conditions as in FIG. 15. That is, a curve $P_4$ indicates the experimental result in the case where the wash liquid containing 0.002M/l of L-ascorbinic acid and 0.002M/l of EDTA(Na) was electrolytically reduced. Although the concentration of the reducing agent is low, a high solubility is attained as in the case of $Fe_2O_3$. However, when the pH of the wash liquid becomes great, the solubility of $Fe_3O_4$ lowers conspicuously.

There was conducted an experiment wherein, in order to increase the solubility of $Fe_3O_4$ in the region of great pH, riboflavin lower in the reference oxidation-reduction potential than L-ascorbinic acid was added to the foregoing wash liquid containing L-ascorbinic acid and EDTA(Na), and the resultant wash liquid was electrolytically reduced with the apparatus of FIG. 14. The concentration of riboflavin in the wash liquid was 0.0001M/l. The pH of the wash liquid was 6.5. At this time, the oxidation-reduction potential of the wash liquid in the dissolution tank 35 lowered down to approximately −0.78 V, and the solubility of $Fe_2O_3$ increased as indicated at $P_5$ in FIG. 16.

Further, there was conducted an experiment wherein instead of riboflavin, rhodamine B was added to the foregoing wash liquid containing L-ascorbinic acid and EDTA(Na), and the resultant wash liquid was electrolytically reduced with the apparatus of FIG. 14. The concentration of rhodamine B in the wash liquid was 0.0001M/l. By electrolytically reducing this wash liquid, the oxidation-reduction potential Ek of the wash liquid in the dissolution tank 35 lowered down to aproximately −0.9 V. The solubility of $Fe_3O_4$ at this time increased up to $P_6$ in FIG. 16. The natural potential of carbon steel under the same condition lowered down to approximately −1.1 V.

As in the electron injection method based on the cathodic polarization, it is desired to the electron injection method employing the reducing agent that the pH of the wash liquid is set within the range of 4–9 in order to suppress the generation of hydrogen.

In the electron injection method employing the reducing agent, the reducing agent in the wash liquid is reduced on the basis of the energy applied from the D.C. power source 23 being the external power source, while the electrons having the energy levels not lower than the Fermi level are afforded to the reducing agent of the wash liquid from the reduction electrode immersed in the wash liquid and the electrons having the energy levels higher than the Fermi level are injected from this reducing agent into the oxide. Therefore, the parent material can be reliably prevented from corroding, and moreover, the oxide can be efficiently dissolved. More specifically, the potential of the parent material metal during the oxide dissolution is lower than the cathode corrosion-protection potential, and exists in the potential range in which the metal is stable as indicated by the region 1 in FIG. 1. Further, since the reducing agent is reduced by the reduction electrode, the reducing agent turned into the oxidizer by affording the electrons to the oxide can be put into the usable state again. For this reason, the frequency addition of a new reducing agent attendant upon the degradation of the reducing agent is not necessary, and the oxide can be dissolved without making the concentration of the reducing agent in the wash liquid higher than is required.

This is advantageous in case of attaching importance to safety as in a nuclear power plant.

The electrode connected to the object to-be-washed need not be immersed in the wash liquid as in the foregoing electron injection method based on the cathodic polarization, but merely the wash liquid having the oxidation-reduction potential lying in the base direction with respect to the Fermi level of the oxide may be supplied. Therefore, the oxide formed on the inner surface of piping installed in a plant can be simply dissolved.

Figure 17:
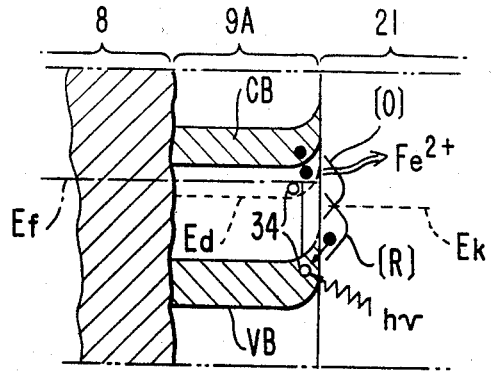
FIG. 17 is an explanatory diagram of a semiconductor model showing a phenomenon in an electron injection method employing light which is another embodiment of this invention.
Figure 18:
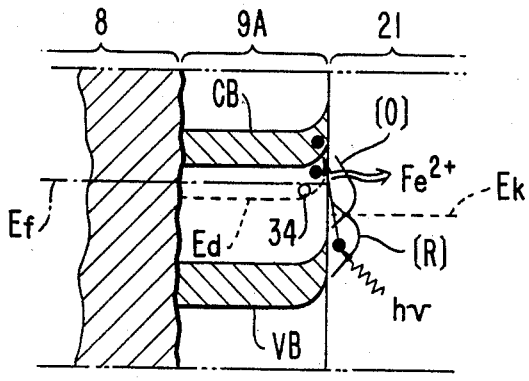
FIG. 18 is an explanatory diagram showing another phenomenon in the electron injection method employing the light.

Lastly, the electron injection method employing light will be explained. As illustrated in FIG. 17, when the surface of metal iron 8 bearing an iron oxide layer 9A thereon is irradiated with light of a wavelength $h\nu$ in a wash liquid 21 containing a reducing agent and a complexing agent, the iron oxide layer 9A absorbs the energy of the light. In consequence, the electrons of the valence band VB existing in the surface of the iron oxide layer 9A are excited to acquire energy levels higher than the Fermi level Ef and therefore to be supplied to the conduction band CB, whereupon they lose the energy and enter positive holes 34 at the donor level Ed. In addition, upon receiving the energy of the light, the electrons of the valence band VB directly enter the positive holes 34 existing at the donor level Ed. Due to such entry of the electrons into the holes 34 of the donor level Ed, the electric double layer existing in the surface of the iron oxide layer 9A disappears, and the bands flatten as in FIG. 10(B). Thus, the dissolution of the iron oxide layer 9A is promoted. More specifically, when the electron has entered the donor level Ed, $Fe^{2+}$ is formed among $Fe^{3+}$ as shown in (B) of FIG. 4. $Fe^{2+}$ is liable to bond with the complexing agent, and is liquated into the wash liquid. Electrons which the reducer [R] in the wash liquid 21 retains are injected into those holes 34 of the valence band VB which have been formed in the manner that the electrons are excited by the light energy and jumped to the conduction band CB. For this reason, the electron of $Fe^{2+}$ created by the reduction does not enter the original hole 34 of the valence band VB. Further, there is a phenomenon in which as illustrated in FIG. 18, the electrons of the reducer [R] are excited by the energy of the projected light to become electrons of energy levels higher than the Fermi level, these electrons being supplied to the conduction band CB of the iron oxide layer 9A. Soon, they lose the energy and enter the positive holes 34 of the donor level Ed. Also in this case, $Fe^{2+}$ is formed in the surface of the iron oxide layer 9A and is liquated into the wash liquid 21 under the action of the complexing agent. In both FIGS. 17 and 18, the oxidation-reduction potential of the wash liquid is lower than the Fermi level. Likewise to the electron injection method based on the cathodic polarization and the electron injection method employing the reducing agent, the electron injection method utilizing the light injects into the iron oxide layer 9A the electrons which have the energy levels not lower than the Fermi level and which are generated outside the parent material metal by the external energy without taking the electrons of the parent material metal of the object to-be-washed. Therefore, the oxides can be dissolved without corroding the parent material metal.

Desirable as the chemicals for use in the present method are ones which dissolve and disappear at or above about 200° C. so as not to remain after the operations. As the complexing agents, therefore, carboxylic acids such as oxalic acid and citric acid and polyaminocarboxylic acids such as ethylenediaminetetraacetic acid (EDTA) are mentioned by way of example. As the reducing agents, ones the oxidation-reduction potentials Ek of which lie in the base direction to the utmost are desirable, and L-ascorbinic acid, riboflavin, methylene viologen and rhodamine B are mentioned by way of example.

In the present method, radiations of wavelengths within an ultraviolet to near-infrared region are used as light sources. As examples of the light sources, there can be mentioned a xenon arc lamp, a tungsten lamp, a halogen lamp and a mercury arc lamp. Among these light sources, especially the light source having a high light intensity in the near-ultraviolet to ultraviolet region in which the light absorption intensities of the oxides increase and in which the absorption of the light by the reducing agent itself takes place is desirable for use. As such, the xenon arc lamp is mentioned by way of example.

Figure 19:
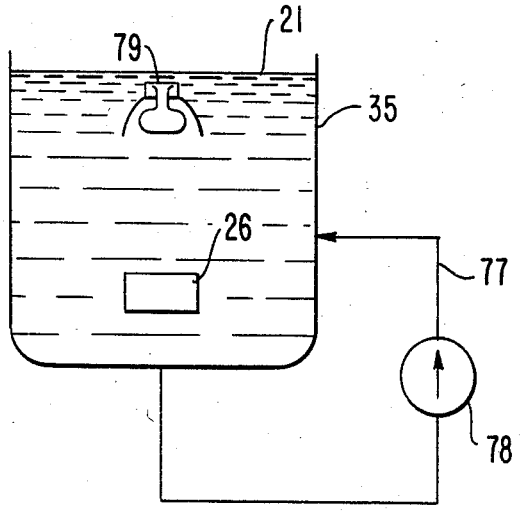
FIG. 19 is a structural diagram of a washing apparatus which is used for the electron injection method employing the light.

An apparatus which is used for the present method is shown in FIG. 19. The washing apparatus is constructed of a dissolution tank 35 which is filled with a wash liquid 21, a circulating pipe 77 whose both ends are connected to the dissolution tank 35, a pump 78 which is installed in the circulating pipe 77, and a xenon arc lamp 79.

An object to-be-washed 26 (for example, a fuel rod or pump impeller in a nuclear power plant) is immersed in the wash liquid 21 which contains a reducing agent and a complexing agent. Whilst circulating the wash liquid 21 in the dissolution tank 35 through the circulating pipe 77 by means of the pump 78, radiation of wavelengths within the ultraviolet to near-infrared region is projected from the xenon arc lamp 79 toward the object to-be-washed 26. As illustrated in FIGS. 17 and 18, the electrons of the valence band VB of the iron oxide layer 9A and the electrons of the reducing agent in the wash liquid 21 absorb the energy of the light to have energy levels not lower than the Fermi level, whereupon they enter the positive holes 34 of the donor level Ed near the surface of the object to-be-washed 26. In consequence, $Fe^{2+}$ whose bond state with $Fe^{3+}$ is unstable as shown in (B) of FIG. 4 is created in the surface of the iron oxide layer 9A. $Fe^{2+}$ bonds with the complexing agent in the wash liquid 21, and is liquated into the wash liquid 21. Due to the entry of the electrons into the holes 34 of the donor level Ed near the surface of the iron oxide layer 9A, the bands flatten as shown in FIG. 10(B) from the state of FIG. 10(A), and hence, the iron oxide layer 9A becomes easy of dissolution. With increase in the energy of the radiation projected on the object to-be-washed 26, the quantity of the electrons which are supplied to the conduction band CB increases, the phenomena of FIGS. 10(C) and 10(D) occur within the iron oxide layer 9A in succession, and the dissolution of the iron oxide layer 9A quickens.

The result of an experiment based on the present method will be given below. Used as the wash liquid 21 was an aqueous solution in which 0.02 M/l of oxalic acid serving as the complexing agent and amounting to 100 c.c. and 0.0002 M/l of L-ascorbinic acid serving as the reducing agent and amounting to 1 c.c. were mixed. This wash liquid 21 was contained in the dissolution tank 35, and the powder of $Fe_2O_3$ (0.15 gr.) was put into the dissolution tank 35. Thereafter, the wash liquid 21 in the dissolution tank 35 was held in the room temperature (15°–19° C.) state and was stirred by a stirrer. At the same time that the $Fe_2O_3$ powder was put into the wash liquid, radiation was projected from the xenon arc lamp of 50 W (wavelengths of 350–550 mm) to the $Fe_2O_3$ powder in the wash liquid 21. In the experiment, the projection period of time was changed as 5 minutes, 30 minutes and 60 minutes. After end of the light projection for each period of time, the wash liquid 21 of 30 c.c. was sampled into a beaker. The sampled wash liquid 21 had undissolved $Fe_2O_3$ removed by a millipore filter of 0.45$\mu$.

Figure 20:
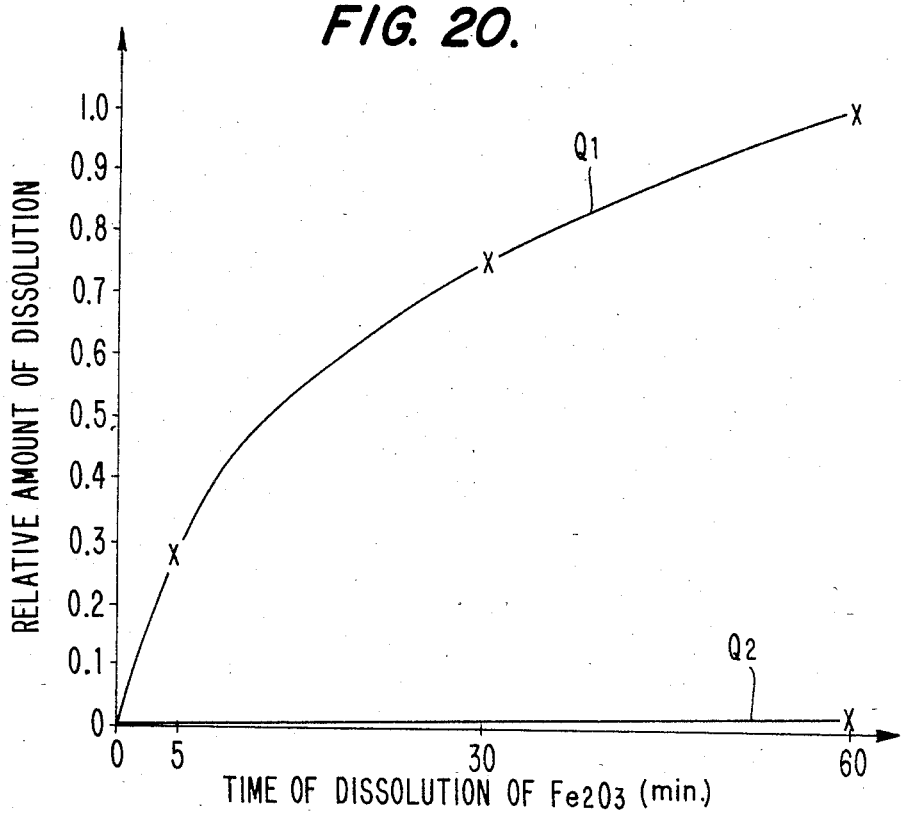
FIG. 20 is a graph showing the relationship between the time of dissolution of $Fe_2O_3$ and the relative amount of dissolution of $Fe_2O_3$.

After each sample of the filtered wash liquid 21 had 0.1 M/l of phenanthroline added by 6 c.c., the absorbance of $Fe^{2+}$ was measured with a spectroscope. FIG. 20 shows the absorbances (indicative of $Fe^{2+}$ concentrations) for the respective periods of time in the case where the absorbance after the light projection time of 60 minutes is taken as unity. A characteristic $Q_1$ is the result of the experiment to which the present method was applied. On the other hand, an experiment was conducted under the state under which the dissolution tank 35 was filled with a wash liquid that contained 0.02 M/l of oxalic acid amounting to 100 c.c. and 0.002 M/l of L-ascorbinic acid amounting to 1 c.c., the powder of $Fe_2O_3$ (0.15 gr.) was put thereinto, and radiation was not externally projected into the dissolution tank 35. At this time, the wash liquid was heated and held at 80° C. while being stirred. $Fe_2O_3$ was immersed in the wash liquid for 1 hour. The result is shown as a characteristic $Q_2$ in FIG. 20. The solubility of $Fe_2O_3$ in the case of projecting radiation when the dissolution time has lapsed 1 hour, becomes about 80 times greater than that in the case of projecting no radiation.

There was conducted an experiment for confirming the reducing dissolution mechanism of $Fe_2O_3$ based on the injection of the electrons into $Fe_2O_3$ attendant upon the light projection. Tyron and barmian blue B being the indicators of $Fe^{3+}$ were added to the wash liquid after the light projection and with $Fe_2O_3$ removed therefrom. In this case, the color development peculiar to $Fe^{3+}$ was not observed unlike the case of $Fe^{2+}$, and the state of the liquated ions was known to be in the form of $Fe^{2+}$.

Figure 21:
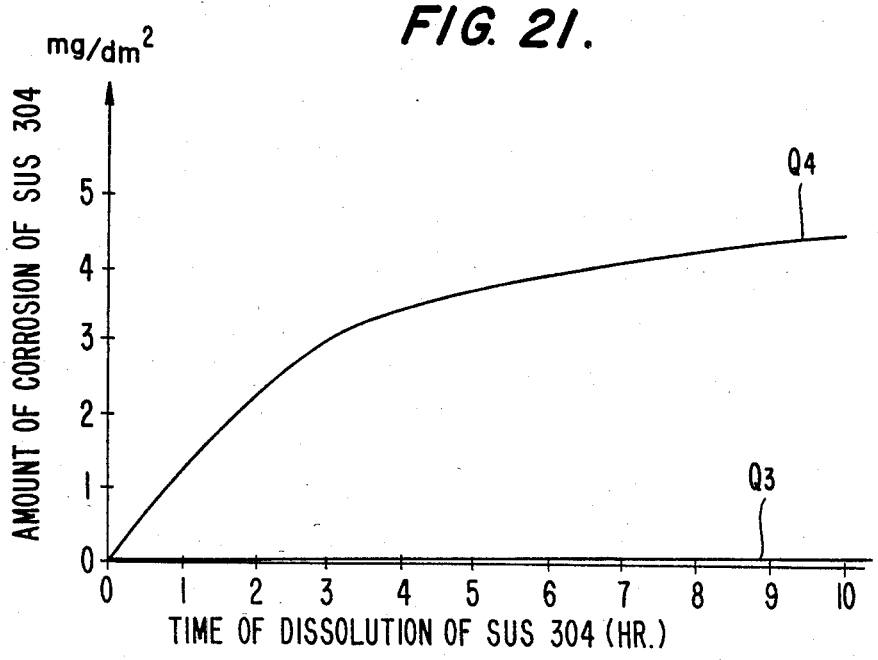
FIG. 21 is a graph showing the relationship between the time of dissolution of SUS 304 and the amount of corrosion thereof.

In addition, the corrosion property in the present method was investigated by the following experiment. Four test pieces of SUS 304 (cubes with one side being 25 mm) covered with aluminum foils to intercept light were immersed in the dissolution tank 35 which contained the wash liquid with the complexing agent and the reducing agent mixed under the same conditions as mentioned above. The wash liquid was heated to 80° C. and held thereat for 10 hours while being stirred by a stirrer. On the other hand, other four test pieces of SUS 304 were immersed in the dissolution tank 35 which was filled with the wash liquid in the room temperature state. Thereafter, whilst stirring the wash liquid, light was projected from the xenon arc lamp of 50 W onto the test pieces. In each of the experiments, the test pieces were respectively taken out upon lapse of 1 hour, 3 hours, 6 hours and 10 hours after the immersion thereof, and the corrosion amounts of the test pieces were measured by a chemical balance. The results are shown in FIG. 21. A characteristic $Q_3$ indicates the amounts of corrosion of the test pieces in the case where the light was projected, while a characteristic $Q_4$ indicates those in the case where the light was not projected. After the treatment period of time of 10 hours, the corrosion amount in the case of projecting the light is remarkably lowered to about 1/90 of that in the case of projecting no light.

It is understood from these experimental results that the oxide absorbs the energy of the light and becomes the readily soluble excitation state by applying the electron injection method utilizing the light, so that even when the pH of the wash liquid is set in the neutral and weakly alkaline regions, i.e., in the range of 4–7, the dissolution rate of the oxide higher than in the conventional method can be attained. In order to suppress the corrosion of the parent material metal to be conspicuously low, the pH of the wash liquid should desirably be set in a range of 4–9.

Since the electron injection method utilizing the light creates the electrons having energy levels higher than the Fermi level of the oxide outside the parent material metal with the energy of the light and injects them into the oxide, it can remarkably suppress the corrosion of the parent material metal and can efficiently remove the oxide. In addition, since the light projection can also be executed locally, the oxide in a part where it adheres in large amounts can be selectively dissolved and removed. It is difficult, however, to apply the present method to the removal of an oxide in piping assembled in a plant.

According to this invention, the corrosion of an object to-be-washed can be conspicuously reduced, and an oxide adherent to the object to-be-washed can be efficiently eliminated.

What we claim is:

1. A method of removing an oxide on a metal surface comprising the steps of:

immersing a metallic part bearing an oxide film thereon in an aqueous solution, said solution containing a complexing agent selected from the group consisting of polyaminocarboxylic acids, polyaminocarboxylic acid salts and carboxylic acids, and a reducing agent selected from the group consisting of L-ascorbinic acid, riboflavin, rose Bengal, rhodamine B, $Cr^{2+}$ and $Sn^{2+}$, in a concentration of at least 0.002 mol/l, and having a pH of 4 to 9; and effecting cathodic electrolysis of the aqueous solution, under application of an electrochemical potential of lower than the Fermi level of the oxide, between an anode and cathode immersed in the solution to reduce part of the solution, at a temperature of lower than 200° C., the metallic part being brought into contact with the reduced solution, thereby to reduce and dissolve the oxide film while suppressing corrosion of the metal surface.

2. A method of removing an oxide on a metal surface as defined in claim 1, wherein the metal of the metal surface is iron, and the oxide is iron oxide.

3. A method of removing an oxide on a metal surface as defined in claim 2, wherein the iron oxide is $Fe_2O_3$ and $Fe_3O_4$.

4. A method of removing an oxide on a metal surface as defined in claim 3, wherein said complexing agent is a polyaminocarboxylic acid salt.

5. A method of removing an oxide on a metal surface as defined in claim 4, wherein the complexing agent is used in an amount of at least 0.1 M/l.

6. A method of removing an oxide on a metal surface as defined in claim 1, wherein said complexing agent is a polyaminocarboxylic acid salt.

7. A method of removing an oxide on a metal surface as defined in claim 1, wherein the potential of the parent material metal on the surface in contact with said liquid is kept below the anticorrosive potential of the metal.

8. A method of removing an oxide on a metal surface as defined in claim 1, wherein the complexing agent is used in an amount of at least 0.1 M/l.

9. A method of removing an oxide on a metal surface as defined in claim 1, wherein said Fermi level of the oxide is −0.7 volts.

10. A method of removing an oxide on a metal surface as defined in claim 1, wherein the metal surface is made of carbon steel, and the oxide film is an iron oxide film.

11. A method of removing an oxide on a metal surface as defined in claim 10, wherein said Fermi level of the oxide is −0.7 volts.

12. A method of removing an oxide on a metal surface as defined in claim 1, wherein said solution has any dissolved oxygen removed therefrom, prior to bringing the metallic part in contact therewith, to thereby increase dissolution of the oxide.

13. A method of removing an oxide on a metal surface comprising the steps of:

immersing a metallic part bearing an oxide film thereon in an aqueous solution, said solution containing a complexing agent selected from the group consisting of polyaminocarboxylic acids, polyaminocarboxylic acid salts and carboxylic acids, and a reducing agent selected from the group consisting of L-ascorbinic acid, riboflavin, methylene viologen, and rhodamine B, in a concentration of at least 0.002 mol/l, and having a pH of 4 to 9, at a temperature of lower than 200° C.; and irradiating the metallic part with rays having wavelengths in an ultraviolet to near-infrared region, thereby to reduce and dissolve the oxide film while suppressing corrosion of the metal surface.

14. A method of removing an oxide on a metal surface as defined in claim 13, wherein said radiation has wavelengths in the ultraviolet to near-ultraviolet region.

15. A method of removing an oxide on a metal surface as defined in claim 13, wherein said metal surface contains iron, and the oxide film is an iron oxide film.

16. A method of removing an oxide on a metal surface as defined in claim 15, wherein said metal surface includes a carbon steel.

17. A method of removing an oxide on a metal surface comprising the steps of:

immersing an anode and cathode in an aqueous solution in a container partitioned by an ion-exchanger membrane, said solution containing a complexing agent selected from the group consisting of polyaminocarboxylic acids, polyaminocarboxylic acid salts and carboxylic acids, and a reducing agent selected from the group consisting of L-ascorbinic acid, riboflavin, rose Bengal, rhodamine B, $Cr^{2+}$ and $Sn^{2+}$, in a concentration of at least 0.002 mol/l, and having a pH of 4 to 9;

effecting cathodic electrolysis of the aqueous solution, under application of an electrochemical potential of lower than the Fermi level of the oxide of the oxide film, between the anode and cathode immersed in the solution to reduce part of the solution, at a temperature of lower than 200° C.; and bringing the metallic part into contact with the reduced solution, thereby to reduce and dissolve the oxide film while suppressing corrosion of the metal surface.

18. A method of removing an oxide on a metal surface as defined in claim 17, wherein the Fermi level of the oxide of the oxide film is −0.7 volts.

19. A method of removing an oxide on a metal surface as defined in claim 17, wherein the metal surface contains iron, and the oxide film is an iron oxide film.

20. A method of removing an oxide on a metal surface as defined in claim 19, wherein the Fermi level of the oxide of the oxide film is −0.7 volts.

21. A method of removing an oxide on a metal surface as defined in claim 19, wherein the metal surface includes carbon steel.

22. A method of removing an oxide on a metal surface as defined in claim 17, wherein the ion-exchanger membrane divides a first container holding said solution into two compartments, with the anode in one of said two compartments and the cathode in the other of said two compartments, and wherein the metallic part is brought into contact with the reduced solution in a second container, said second container being in flow communication with the compartment of the first container having therein the cathode.

23. A method of removing an oxide on a metal surface as defined in claim 17, wherein the ion-exchanger membrane is a cation exchange film.

24. A method of removing an oxide on a metal surface as defined in claim 17, wherein, in effecting cathodic electrolysis to reduce part of the solution, the solution has dissolved oxygen removed therefrom, whereby dissolution of the oxide is increased.

* * * * *